US007946406B2

(12) United States Patent
Blake et al.

(10) Patent No.: US 7,946,406 B2
(45) Date of Patent: May 24, 2011

(54) COIN PROCESSING DEVICE HAVING A MOVEABLE COIN RECEPTACLE STATION

(75) Inventors: John R. Blake, St. Charles, IL (US); David J. Mecklenburg, Glendale Heights, IL (US); Marianne Krbec, Wood Dales, IL (US)

(73) Assignee: Cummins-Allison Corp., Mt. Prospect, IL (US)

( * ) Notice: Subject to any disclaimer, the term of this patent is extended or adjusted under 35 U.S.C. 154(b) by 248 days.

(21) Appl. No.: 11/598,370

(22) Filed: Nov. 13, 2006

(65) Prior Publication Data

US 2007/0119681 A1 May 31, 2007

Related U.S. Application Data

(60) Provisional application No. 60/735,783, filed on Nov. 12, 2005, provisional application No. 60/735,782, filed on Nov. 12, 2005.

(51) Int. Cl.
*G07C 3/00* (2006.01)
*G07C 9/02* (2006.01)

(52) U.S. Cl. ..... 194/200

(58) Field of Classification Search ..... 194/317, 194/200, 204; 902/38
See application file for complete search history.

(56) References Cited

U.S. PATENT DOCUMENTS

| | | | | |
|---|---|---|---|---|
| 446,303 | A | 2/1891 | Thompson | |
| 2,669,998 | A | 2/1954 | Buchholz | 133/8 |
| 2,750,949 | A | 6/1956 | Kulo et al. | 133/8 |
| 2,835,260 | A | 5/1958 | Buchholz | 133/8 |
| 2,865,561 | A | 12/1958 | Rosapepe | 232/7 |
| 2,936,684 | A | 5/1960 | Simjian | 95/11 |
| 3,104,314 | A | 9/1963 | Simjian | 235/619 |
| 3,132,654 | A | 5/1964 | Adams | 133/1 |

(Continued)

FOREIGN PATENT DOCUMENTS

| | | |
|---|---|---|
| EP | 0 109 743 | 5/1984 |

(Continued)

OTHER PUBLICATIONS

AUI: Coinverter—"No More Lines . . . Self-Serve Cash-Out," by Cassius Elston, 1995 World Games Congress/Exposition Converter, 1 page (dated prior to 1995).
Brandt: 95 Series Coin Sorter Counter, 2 pages (1982).
Brandt: Mach 7 High-Speed Coin Sorter/Counter, 2 pages (1992).
Brandt: Model 1205 Coin Sorter Counter, 2 pages (1986).
Brandt: Model 817 Automated Coin and Currency Ordering System, 2 pages (1983).

(Continued)

*Primary Examiner* — Jeffrey A Shapiro
*Assistant Examiner* — Mark J Beauchaine
(74) *Attorney, Agent, or Firm* — Nixon Peabody LLP

(57) ABSTRACT

A coin processing system includes a coin processing machine configured to receive a plurality of randomly oriented coins in a coin input region thereof, process the coins, and determine a total amount of the coins. The coin processing system also includes a sensor configured to measure a pre-determined property associated with a component of the coin processing machine and/or an operational state of the coin processing machine and to output to a controller a signal related thereto. The coin processing system also includes an actuating device disposed to influence the pre-determined property. A controller is configured to monitor the signal output by the sensor and, responsive to a deviation of a value of the signal from an acceptable value for the signal, to execute an error recovery instruction set at least once. Execution of the error recovery instruction set by the controller causes an actuation of the actuating device to influence the pre-determined property to attempt to restore the operational parameter to a condition wherein the signal output by the sensor is within an acceptable value for the pre-determined property.

17 Claims, 8 Drawing Sheets

U.S. PATENT DOCUMENTS

| | | | | |
|---|---|---|---|---|
| 3,148,932 | A | 9/1964 | Simjian | 346/22 |
| 3,150,912 | A | 9/1964 | Simjian | 346/22 |
| 3,173,742 | A | 3/1965 | Simjian | 346/22 |
| 3,246,295 | A | 4/1966 | DeClaris et al. | 382/56 |
| 3,280,974 | A | 10/1966 | Riddle et al. | |
| 3,443,107 | A | 5/1969 | Modglin | 250/219 |
| 3,480,785 | A | 11/1969 | Aufderheide | 250/219 |
| 3,496,370 | A | 2/1970 | Haville et al. | 250/219 |
| 3,509,535 | A | 4/1970 | Berube | 340/149 |
| 3,612,835 | A | 10/1971 | Andrews et al. | |
| 3,618,765 | A | 11/1971 | Cooper et al. | 209/122 |
| 3,656,615 | A | 4/1972 | Ptacek | 209/73 |
| 3,679,314 | A | 7/1972 | Mustert | 356/71 |
| 3,705,384 | A | 12/1972 | Wahlberg | 705/5 |
| 3,715,031 | A | 2/1973 | Okkonen | 209/75 |
| 3,725,667 | A | 4/1973 | Schwartz | 250/219 DQ |
| 3,764,899 | A | 10/1973 | Peterson | 324/61 R |
| 3,778,595 | A | 12/1973 | Hatanaka et al. | 235/379 |
| 3,778,628 | A | 12/1973 | Novak et al. | 250/556 |
| 3,782,543 | A | 1/1974 | Martelli et al. | 209/75 |
| 3,798,603 | A | 3/1974 | Wahlberg | 340/149 |
| 3,800,078 | A | 3/1974 | Cochran et al. | 178/71 |
| 3,806,710 | A | 4/1974 | Shigemori et al. | 235/92 |
| 3,815,021 | A | 6/1974 | Kerr | 324/61 R |
| 3,842,281 | A | 10/1974 | Goodrich | 250/461 |
| 3,870,629 | A | 3/1975 | Carter et al. | |
| 3,906,449 | A | 9/1975 | Marchak | 340/149 R |
| 3,916,922 | A | 11/1975 | Prumm | 133/3 R |
| 3,930,582 | A | 1/1976 | Gartner et al. | 209/88 |
| 3,966,047 | A | 6/1976 | Steiner | 209/75 |
| 3,976,198 | A | 8/1976 | Carnes, Jr. et al. | |
| 3,998,237 | A | 12/1976 | Kressin | |
| 4,023,011 | A | 5/1977 | Nakajima et al. | |
| 4,041,456 | A | 8/1977 | Ott et al. | 382/135 |
| 4,059,122 | A | 11/1977 | Kinoshita | 133/3 D |
| 4,075,460 | A | 2/1978 | Gorgens | 235/420 |
| 4,096,991 | A | 6/1978 | Iguchi | 235/419 |
| 4,109,238 | A | 8/1978 | Creekmore | 340/149 |
| 4,114,804 | A | 9/1978 | Jones et al. | 235/476 |
| 4,147,430 | A | 4/1979 | Gorgone et al. | 356/51 |
| 4,150,740 | A | 4/1979 | Douno | 194/4 C |
| 4,166,945 | A | 9/1979 | Inoyama et al. | 235/379 |
| 4,172,462 | A | 10/1979 | Uchida et al. | 133/3 A |
| 4,179,685 | A | 12/1979 | O'Maley | |
| 4,187,463 | A | 2/1980 | Kivenson | 324/228 |
| 4,197,986 | A | 4/1980 | Nagata | 235/379 |
| 4,205,780 | A | 6/1980 | Burns et al. | 235/454 |
| 4,208,549 | A | 6/1980 | Polillo et al. | |
| 4,231,014 | A | 10/1980 | Ponzio | |
| 4,232,295 | A | 11/1980 | McConnell | |
| 4,237,378 | A | 12/1980 | Jones | 250/223 R |
| 4,249,552 | A | 2/1981 | Margolin et al. | 133/1 R |
| 4,250,806 | A | 2/1981 | Boyson et al. | 101/2 |
| 4,251,867 | A | 2/1981 | Uchida et al. | 364/408 |
| 4,255,651 | A | 3/1981 | Phillips | 235/92 |
| 4,264,808 | A | 4/1981 | Owens et al. | 235/379 |
| 4,266,121 | A | 5/1981 | Hirose | 235/381 |
| 4,275,874 | A | 6/1981 | DiBlasio | 271/4 |
| 4,277,774 | A | 7/1981 | Fujii et al. | |
| 4,283,708 | A | 8/1981 | Lee | |
| 4,286,703 | A | 9/1981 | Schuller et al. | 194/100 |
| 4,288,781 | A | 9/1981 | Sellner et al. | |
| 4,302,781 | A | 11/1981 | Ikeda et al. | 358/486 |
| 4,310,885 | A | 1/1982 | Azcua et al. | 364/405 |
| 4,311,914 | A | 1/1982 | Huber | 250/556 |
| 4,313,598 | A | 2/1982 | DiBlasio | 271/124 |
| 4,317,957 | A | 3/1982 | Sendrow | 705/71 |
| 4,321,672 | A | 3/1982 | Braun et al. | 364/408 |
| 4,334,619 | A | 6/1982 | Horino et al. | 209/551 |
| 4,337,864 | A | 7/1982 | McLean | 209/534 |
| 4,341,951 | A | 7/1982 | Benton | 705/41 |
| 4,348,656 | A | 9/1982 | Gorgone et al. | |
| 4,349,111 | A | 9/1982 | Shah et al. | 209/534 |
| 4,352,988 | A | 10/1982 | Ishida | 250/559 |
| 4,355,300 | A | 10/1982 | Weber | |
| 4,355,369 | A | 10/1982 | Garvin | 364/900 |
| 4,356,473 | A | 10/1982 | Freudenthal | |
| 4,360,034 | A | 11/1982 | Davila et al. | 133/3 |
| 4,380,316 | A | 4/1983 | Glinka et al. | 232/16 |
| 4,381,447 | A | 4/1983 | Horvath et al. | 250/223 |
| 4,383,540 | A | 5/1983 | DeMeyer et al. | 133/3 H |
| 4,386,432 | A | 5/1983 | Nakamura et al. | 382/7 |
| 4,396,902 | A | 8/1983 | Warthan et al. | 382/64 |
| 4,412,292 | A | 10/1983 | Sedam et al. | 364/479 |
| 4,416,299 | A | 11/1983 | Bergman | 133/1 R |
| 4,420,153 | A | 12/1983 | Winkler et al. | 271/304 |
| 4,434,359 | A | 2/1984 | Watanabe | 235/379 |
| 4,441,205 | A | 4/1984 | Berkin et al. | 382/8 |
| 4,442,541 | A | 4/1984 | Finkel et al. | 382/7 |
| 4,449,240 | A | 5/1984 | Yoshida | 382/15 |
| 4,454,414 | A | 6/1984 | Benton | 705/41 |
| 4,461,028 | A | 7/1984 | Okubo | 382/15 |
| 4,464,786 | A | 8/1984 | Nishito et al. | 382/7 |
| 4,464,787 | A | 8/1984 | Fish et al. | 382/7 |
| RE31,692 | E | 10/1984 | Tyburski et al. | 382/7 |
| 4,480,177 | A | 10/1984 | Allen | 235/379 |
| 4,487,306 | A | 12/1984 | Nao et al. | 194/4 |
| 4,490,846 | A | 12/1984 | Ishida et al. | 382/7 |
| 4,513,439 | A | 4/1985 | Gorgone et al. | 382/7 |
| 4,521,008 | A | 6/1985 | Granzow et al. | 271/3 |
| 4,523,087 | A | 6/1985 | Benton | 235/379 |
| 4,530,067 | A | 7/1985 | Dorr | 364/900 |
| 4,538,719 | A | 9/1985 | Gray et al. | 194/100 A |
| 4,539,702 | A | 9/1985 | Oka | 382/7 |
| 4,542,829 | A | 9/1985 | Emery et al. | 209/534 |
| 4,543,969 | A | 10/1985 | Rasmussen | 133/3 |
| 4,544,266 | A | 10/1985 | Antes | 356/71 |
| 4,547,896 | A | 10/1985 | Ohtombe et al. | 382/7 |
| 4,553,222 | A | 11/1985 | Kurland et al. | 364/900 |
| 4,553,846 | A | 11/1985 | Hilton et al. | 356/429 |
| 4,556,140 | A | 12/1985 | Okada | 194/4 |
| 4,558,224 | A | 12/1985 | Gober | |
| 4,558,711 | A | 12/1985 | Yoshiaki et al. | 133/3 F |
| 4,559,451 | A | 12/1985 | Curl | 250/560 |
| 4,563,771 | A | 1/1986 | Gorgone et al. | 382/7 |
| 4,567,370 | A | 1/1986 | Falls | |
| 4,569,421 | A | 2/1986 | Sandstedt | 186/39 |
| 4,582,172 | A | 4/1986 | Takeuchi et al. | 186/38 |
| 4,584,529 | A | 4/1986 | Aoyama | 324/261 |
| 4,587,412 | A | 5/1986 | Apisdorf | 235/449 |
| 4,587,434 | A | 5/1986 | Roes et al. | 250/556 |
| 4,590,606 | A | 5/1986 | Rohrer | 382/7 |
| 4,592,090 | A | 5/1986 | Curl et al. | 382/7 |
| 4,593,184 | A | 6/1986 | Bryce | |
| 4,594,664 | A | 6/1986 | Hashimoto | 364/405 |
| 4,602,332 | A | 7/1986 | Hirose et al. | 364/408 |
| D285,095 | S | 8/1986 | Lundgren et al. | D18/3 |
| 4,605,926 | A | 8/1986 | Onishi et al. | |
| 4,611,205 | A | 9/1986 | Eglise | |
| 4,611,345 | A | 9/1986 | Ohnishi et al. | 382/7 |
| 4,617,458 | A | 10/1986 | Bryce | 235/449 |
| 4,620,559 | A | 11/1986 | Childers et al. | 133/3 A |
| 4,622,456 | A | 11/1986 | Naruto et al. | 235/379 |
| 4,628,194 | A | 12/1986 | Dobbins et al. | 235/379 |
| 4,641,239 | A | 2/1987 | Takesako | 705/41 |
| 4,645,936 | A | 2/1987 | Gorgone | 250/556 |
| 4,653,647 | A | 3/1987 | Hashimoto | 209/534 |
| 4,658,289 | A | 4/1987 | Nagano et al. | 358/75 |
| 4,676,343 | A | 6/1987 | Humble et al. | 186/61 |
| 4,677,682 | A | 6/1987 | Miyagawa et al. | 382/7 |
| 4,678,072 | A | 7/1987 | Kobayashi et al. | 194/206 |
| 4,685,141 | A | 8/1987 | Hoque et al. | 382/7 |
| 4,686,357 | A | 8/1987 | Douno et al. | 235/379 |
| 4,694,963 | A | 9/1987 | Takesako | 209/534 |
| 4,697,071 | A | 9/1987 | Hiraoka et al. | 235/379 |
| 4,700,368 | A | 10/1987 | Munn et al. | 377/8 |
| 4,706,577 | A | 11/1987 | Jones | 109/59 T |
| 4,716,456 | A | 12/1987 | Hosaka | 358/75 |
| 4,733,308 | A | 3/1988 | Nakamura et al. | 358/496 |
| 4,733,765 | A | 3/1988 | Watanabe | 194/206 |
| 4,735,289 | A | 4/1988 | Kenyon | 186/37 |
| 4,743,743 | A | 5/1988 | Fukatsu | 235/379 |
| 4,743,974 | A | 5/1988 | Lockwood | 358/285 |
| 4,748,679 | A | 5/1988 | Gold et al. | 382/61 |
| 4,749,087 | A | 6/1988 | Buttifant | 209/534 |
| 4,753,625 | A | 6/1988 | Okada | 453/32 |
| 4,764,725 | A | 8/1988 | Bryce | 324/234 |

4,764,976 A 8/1988 Kallin et al. ..... 382/65
4,766,548 A 8/1988 Cedrone et al.
4,775,353 A 10/1988 Childers et al. ..... 453/6
4,778,983 A 10/1988 Ushikubo ..... 235/381
4,782,328 A 11/1988 Denlinger ..... 340/365
4,784,274 A 11/1988 Mori et al. ..... 209/534
4,803,347 A 2/1989 Sugahara et al. ..... 235/379
4,804,830 A 2/1989 Miyagisima et al. ..... 235/379
4,806,709 A 2/1989 Evans ..... 178/19
4,811,004 A 3/1989 Person et al. ..... 340/712
4,817,176 A 3/1989 Marshall et al. ..... 382/43
4,821,332 A 4/1989 Durham ..... 382/7
4,823,393 A 4/1989 Kawakami ..... 382/7
4,825,246 A 4/1989 Fukuchi et al. ..... 355/4
4,827,531 A 5/1989 Milford ..... 382/7
4,833,307 A 5/1989 Gonzalez-Justiz ..... 235/375
4,833,312 A 5/1989 Minematsu et al. ..... 235/379
4,837,842 A 6/1989 Holt ..... 382/26
4,841,358 A 6/1989 Kammoto et al. ..... 358/75
4,844,369 A 7/1989 Kanayachi ..... 242/56 R
4,851,616 A 7/1989 Wales et al. ..... 178/18
4,877,230 A 10/1989 Winkler et al. ..... 271/3
4,880,096 A 11/1989 Kobayashi et al. ..... 194/206
4,881,268 A 11/1989 Uchida et al. ..... 382/7
4,883,158 A 11/1989 Kobayashi et al. ..... 194/217
4,883,181 A 11/1989 Yoshikawa ..... 209/534
4,884,212 A 11/1989 Stutsman ..... 700/237
4,888,812 A 12/1989 Dinan et al. ..... 382/7
4,903,953 A 2/1990 Winkler et al. ..... 271/4
4,905,839 A 3/1990 Yuge et al. ..... 209/534
4,905,840 A 3/1990 Yuge et al. ..... 209/534
4,908,516 A 3/1990 West ..... 250/556
4,921,463 A 5/1990 Primdahl et al. ..... 453/3
4,922,109 A 5/1990 Bercovitz et al. ..... 194/207
4,928,094 A 5/1990 Smith ..... 340/712
4,931,782 A 6/1990 Jackson ..... 340/706
4,947,441 A 8/1990 Hara et al. ..... 382/7
4,953,086 A 8/1990 Fukatsu ..... 364/408
4,954,697 A 9/1990 Kokubun et al. ..... 235/381
4,970,655 A 11/1990 Winn et al. ..... 364/479
4,973,851 A 11/1990 Lee ..... 250/556
4,980,543 A 12/1990 Hara et al. ..... 209/534
4,988,849 A 1/1991 Sasaki et al. ..... 235/379
4,992,860 A 2/1991 Hamaguchi et al. ..... 358/75
4,995,848 A 2/1991 Goh ..... 453/3
4,996,604 A 2/1991 Oqawa et al. ..... 358/486
5,010,238 A 4/1991 Kadono et al. ..... 235/379
5,023,782 A 6/1991 Lutz et al. ..... 364/405
5,025,139 A 6/1991 Halliburton, Jr. ..... 235/379
5,027,415 A 6/1991 Hara et al. ..... 382/7
5,039,848 A 8/1991 Stoken ..... 235/381
5,040,226 A 8/1991 Elischer et al. ..... 382/7
5,047,871 A 9/1991 Meyer et al. ..... 358/486
5,054,621 A 10/1991 Murphy et al. ..... 209/534
5,055,657 A 10/1991 Miller et al. ..... 235/381
5,055,834 A 10/1991 Chiba ..... 340/825
5,063,599 A 11/1991 Concannon et al. ..... 382/7
5,064,999 A 11/1991 Okamoto et al. ..... 235/379
5,068,519 A 11/1991 Bryce ..... 235/449
5,076,441 A 12/1991 Gerlier ..... 209/534
5,080,633 A 1/1992 Ristvedt et al. ..... 435/6
5,091,713 A 2/1992 Horne et al. ..... 340/541
5,091,961 A 2/1992 Baus, Jr. ..... 382/7
5,105,601 A 4/1992 Horiguchi et al. ..... 53/465
5,114,381 A 5/1992 Ueda et al. ..... 453/57
5,120,944 A 6/1992 Kern et al. ..... 235/379
5,120,945 A 6/1992 Nishibe et al. ..... 235/379
5,122,754 A 6/1992 Gotaas ..... 324/676
5,134,663 A 7/1992 Kozlowski ..... 382/7
5,135,115 A 8/1992 Miller et al. ..... 209/564
5,140,517 A 8/1992 Nagata et al. ..... 364/408
5,144,115 A 9/1992 Yoshida ..... 235/379
5,146,067 A 9/1992 Sloan et al. ..... 235/381
5,146,512 A 9/1992 Weideman et al. ..... 382/30
5,151,607 A 9/1992 Crane et al. ..... 250/556
5,154,272 A 10/1992 Nishiumi et al. ..... 194/318
5,159,548 A 10/1992 Caslavka ..... 364/408
5,163,672 A 11/1992 Mennie ..... 271/187
5,163,868 A 11/1992 Adams et al. ..... 453/11
5,167,313 A 12/1992 Dobbins et al. ..... 194/317
5,175,416 A 12/1992 Mansvelt et al.
5,179,517 A 1/1993 Sarbin et al. ..... 463/25
5,183,142 A 2/1993 Katchinian et al. ..... 194/206
5,184,115 A 2/1993 Black et al. ..... 340/708
5,184,709 A 2/1993 Nishiumi et al. ..... 194/318
5,186,334 A 2/1993 Fukudome et al. ..... 209/534
5,187,750 A 2/1993 Behera ..... 382/7
5,193,121 A 3/1993 Elischer et al. ..... 382/7
5,198,976 A 3/1993 Form et al. ..... 364/410
5,199,543 A 4/1993 Kamagami et al. ..... 194/207
5,201,395 A 4/1993 Takizawa et al. ..... 194/206
5,207,788 A 5/1993 Geib et al. ..... 271/122
5,231,381 A 7/1993 Duwaer ..... 340/712
5,237,158 A 8/1993 Kern et al. ..... 235/379
5,239,593 A 8/1993 Wittner et al. ..... 382/14
5,243,174 A 9/1993 Veeneman et al. ..... 235/381
5,251,738 A 10/1993 Dabrowski ..... 194/206
5,252,167 A 10/1993 Hoppe et al. ..... 364/408
5,252,811 A 10/1993 Henochowicz et al. ..... 235/379
5,253,167 A 10/1993 Yoshida et al. ..... 364/408
5,261,518 A 11/1993 Bryce ..... 194/206
5,265,008 A 11/1993 Benton et al. ..... 364/408
5,279,403 A 1/1994 Harbaugh et al. ..... 194/207
5,282,127 A 1/1994 Mii
5,286,954 A 2/1994 Sato et al. ..... 235/379
5,291,003 A 3/1994 Avnet et al. ..... 235/381
5,293,981 A 3/1994 Abe et al. ..... 194/347
5,295,196 A 3/1994 Raterman et al. ..... 382/135
5,297,030 A 3/1994 Vassigh et al. ..... 364/405
5,299,977 A 4/1994 Mazur et al. ..... 453/10
5,302,811 A 4/1994 Fukatsu ..... 235/381
5,304,813 A 4/1994 DeMan ..... 250/556
5,308,992 A 5/1994 Crane et al. ..... 250/556
5,309,515 A 5/1994 Troung et al. ..... 382/7
5,317,140 A 5/1994 Dunthorn ..... 250/221
5,321,238 A 6/1994 Kamata et al. ..... 235/379
5,335,292 A 8/1994 Lovelady et al. ..... 382/17
5,341,408 A 8/1994 Melcher et al. ..... 377/8
5,342,165 A 8/1994 Graef et al.
5,363,949 A 11/1994 Matsubayashi ..... 194/206
5,367,577 A 11/1994 Gotaas ..... 382/7
5,368,147 A 11/1994 Menke et al. ..... 194/206
5,371,345 A 12/1994 LeStrange et al. ..... 235/380
5,371,798 A 12/1994 McWhortor ..... 380/51
5,373,550 A 12/1994 Campbell et al. ..... 379/100
5,374,814 A 12/1994 Kako et al. ..... 235/379
5,379,344 A 1/1995 Larson et al. ..... 380/23
5,381,019 A 1/1995 Sato ..... 250/556
5,390,776 A 2/1995 Thompson ..... 194/346
5,394,969 A 3/1995 Harbaugh ..... 194/206
5,399,874 A 3/1995 Gonsalves et al. ..... 250/556
5,402,895 A 4/1995 Mikkelsen et al. ..... 209/534
5,417,316 A 5/1995 Harbaugh ..... 194/206
5,418,458 A 5/1995 Jeffers ..... 324/235
5,419,424 A 5/1995 Harbaugh ..... 194/206
5,421,443 A 6/1995 Hatamachic et al. ..... 914/206
5,430,664 A 7/1995 Cargill et al. ..... 364/550
5,434,427 A 7/1995 Crane et al. ..... 250/556
5,437,357 A 8/1995 Ota et al. ..... 194/206
5,438,184 A 8/1995 Roberts et al. ..... 235/380
5,440,108 A 8/1995 Tran et al. ..... 235/381
5,444,793 A 8/1995 Kelland ..... 382/138
5,444,794 A 8/1995 Uhland, Sr. ..... 382/137
5,450,938 A 9/1995 Rademacher ..... 194/206
5,453,601 A 9/1995 Rosen ..... 235/379
5,459,304 A 10/1995 Eisenmann ..... 235/380
5,465,301 A 11/1995 Jotcham et al. ..... 380/54
5,465,821 A 11/1995 Akioka ..... 194/207
5,467,405 A 11/1995 Raterman et al. ..... 382/135
5,467,406 A 11/1995 Graves et al. ..... 382/135
5,468,971 A 11/1995 Ebstein et al. ..... 250/556
5,470,079 A 11/1995 LeStrange et al. ..... 273/138
5,476,169 A 12/1995 Takarada et al. ..... 194/207
5,481,377 A 1/1996 Udagawa et al. ..... 358/501
5,486,067 A 1/1996 Huynh et al.
5,488,671 A 1/1996 Kern ..... 382/138
5,500,514 A 3/1996 Veeneman et al. ..... 235/381
5,504,822 A 4/1996 Holt ..... 382/218

5,506,691 A 4/1996 Bednar et al. 358/402
5,507,379 A 4/1996 Mazur et al. 194/318
D369,984 S 5/1996 Larsen D10/97
5,523,575 A 6/1996 Machida et al.
5,530,772 A 6/1996 Storey 382/135
5,537,486 A 7/1996 Stratigos et al. 382/137
5,544,043 A 8/1996 Miki et al. 364/406
5,544,086 A 8/1996 Davis et al. 705/68
5,545,885 A 8/1996 Jagielinski 235/449
5,553,320 A 9/1996 Matsuura et al. 235/379
5,559,887 A 9/1996 Davis et al. 380/24
5,564,546 A 10/1996 Molbak et al. 194/216
5,586,036 A 12/1996 Pintsov 364/464
5,592,377 A 1/1997 Lipkin 395/242
5,600,732 A 2/1997 Ott et al. 382/112
5,602,933 A 2/1997 Blackwell et al. 382/116
5,602,936 A 2/1997 Green et al. 382/140
5,607,040 A 3/1997 Mathurin, Sr. 194/207
5,615,280 A 3/1997 Izawa et al. 382/135
5,620,079 A 4/1997 Molbak 194/217
5,623,427 A 4/1997 Jones et al. 705/68
5,625,562 A 4/1997 Veeneman et al.
5,633,949 A 5/1997 Graves et al. 382/135
5,637,845 A 6/1997 Kolls 235/381
5,640,463 A 6/1997 Csulits 382/135
5,641,050 A 6/1997 Smith et al. 194/210
5,650,605 A 7/1997 Morioka et al. 273/153
5,652,421 A 7/1997 Veeneman et al. 235/381
5,652,802 A 7/1997 Graves et al. 382/135
5,657,846 A 8/1997 Schwartz 194/206
5,665,952 A 9/1997 Ziarno 235/380
5,678,046 A 10/1997 Cahill et al. 395/616
5,679,070 A * 10/1997 Ishida et al. 453/41
5,680,472 A 10/1997 Conant 382/135
5,687,963 A 11/1997 Mennie 271/119
5,692,067 A 11/1997 Raterman et al. 382/135
5,704,491 A 1/1998 Graves 209/534
5,719,948 A 2/1998 Liang 382/112
5,724,438 A 3/1998 Graves 382/135
5,727,667 A 3/1998 Nye 194/207
5,729,623 A 3/1998 Omatu et al. 382/155
5,746,299 A 5/1998 Molbak et al. 194/200
5,751,840 A 5/1998 Raterman et al. 382/135
5,751,842 A 5/1998 Riach et al. 382/137
5,754,673 A 5/1998 Brooks et al. 382/112
5,761,089 A 6/1998 Mcinerny 364/550
5,774,874 A 6/1998 Veeneman et al. 705/27
5,781,654 A 7/1998 Carney 382/137
5,790,693 A 8/1998 Graves et al. 382/135
5,790,697 A 8/1998 Munro et al. 382/135
5,799,767 A 9/1998 Molbak 194/217
5,806,650 A 9/1998 Mennie et al. 194/206
5,813,510 A 9/1998 Rademacher 194/206
5,815,592 A 9/1998 Mennie et al. 382/135
5,822,448 A 10/1998 Graves et al. 382/135
5,830,054 A 11/1998 Petri 453/5
5,832,104 A 11/1998 Graves et al. 382/135
5,832,463 A 11/1998 Funk 705/35
5,842,188 A 11/1998 Ramsey et al. 705/68
5,842,916 A 12/1998 Gerrity et al. 453/57
5,850,076 A 12/1998 Morioka et al. 235/379
5,852,811 A 12/1998 Atkins 705/36
5,854,581 A 12/1998 Mori et al. 235/379
5,867,589 A 2/1999 Graves et al. 382/135
5,870,487 A 2/1999 Graves et al. 382/135
5,875,259 A 2/1999 Mennie et al. 382/135
5,880,444 A 3/1999 Shibata et al. 235/379
5,892,211 A 4/1999 Davis et al. 235/380
5,905,810 A 5/1999 Jones et al. 382/135
5,909,502 A 6/1999 Mazur 382/135
5,909,503 A 6/1999 Graves et al. 382/135
5,909,793 A 6/1999 Beach et al. 194/210
5,909,794 A 6/1999 Molbak et al. 194/216
5,912,982 A 6/1999 Munro et al. 382/135
5,913,399 A * 6/1999 Takemoto et al. 194/200
5,918,748 A 7/1999 Clark et al. 209/534
5,926,550 A 7/1999 Davis 380/25
5,938,044 A 8/1999 Weggesser 209/534
5,940,623 A 8/1999 Watts et al. 395/712
5,940,844 A 8/1999 Cahill et al. 707/526
5,943,655 A 8/1999 Jacobsen 705/30
5,944,600 A 8/1999 Zimmermann 453/10
5,947,255 A 9/1999 Shimada et al. 194/207
5,957,262 A 9/1999 Molbak et al. 194/200
5,960,103 A 9/1999 Graves et al. 382/135
5,966,456 A 10/1999 Jones et al. 382/135
5,982,918 A 11/1999 Mennie et al. 382/135
5,988,348 A 11/1999 Martin et al. 194/317
5,992,601 A 11/1999 Mennie et al. 194/207
5,995,949 A 11/1999 Morioka et al. 705/43
6,012,565 A 1/2000 Mazur 194/207
6,017,270 A 1/2000 Ristvedt et al. 453/5
6,021,883 A 2/2000 Casanova et al. 194/217
6,023,684 A 2/2000 Pearson 705/35
6,026,175 A 2/2000 Munro et al. 382/135
6,028,951 A 2/2000 Raterman et al. 382/135
D422,016 S 3/2000 Forslund D18/3
6,032,859 A 3/2000 Muehlberger et al.
6,038,553 A 3/2000 Hyde, Jr. 705/45
6,039,645 A 3/2000 Mazur 453/10
6,047,807 A 4/2000 Molbak 194/217
6,047,808 A 4/2000 Neubarth et al. 194/317
6,056,104 A 5/2000 Neubarth et al. 194/317
6,068,194 A 5/2000 Mazur 235/492
6,072,896 A 6/2000 Graves et al. 382/135
6,073,744 A 6/2000 Raterman et al. 194/207
6,074,334 A 6/2000 Mennie et al. 493/438
6,080,056 A 6/2000 Karlsson 453/3
D427,623 S 7/2000 Kuwada et al. D18/3
6,082,519 A 7/2000 Martin et al. 194/350
6,086,471 A 7/2000 Zimmermann 453/3
6,095,313 A 8/2000 Molbak et al. 194/344
6,116,402 A 9/2000 Beach et al. 194/216
6,128,402 A 10/2000 Jones et al. 382/135
6,145,738 A 11/2000 Stinson et al. 235/379
6,220,419 B1 4/2001 Mennie 194/207
6,230,928 B1 5/2001 Hanna et al. 221/13
6,237,565 B1 5/2001 Engelgau
6,237,739 B1 5/2001 Mazur et al. 194/207
6,241,069 B1 6/2001 Mazur et al. 194/207
6,256,407 B1 7/2001 Mennie et al. 382/135
6,278,795 B1 8/2001 Anderson et al. 382/135
6,283,366 B1 9/2001 Hills et al. 235/379
6,308,887 B1 10/2001 Korman et al. 235/379
6,311,819 B1 11/2001 Stromme et al. 194/207
6,318,536 B1 11/2001 Korman et al. 194/217
6,318,537 B1 11/2001 Jones et al. 914/346
6,336,544 B1 * 1/2002 Blad et al. 194/217
6,351,551 B1 2/2002 Munro et al. 382/135
6,354,491 B2 3/2002 Nichols et al. 235/379
6,363,164 B1 3/2002 Jones et al. 382/135
6,371,303 B1 4/2002 Klein et al. 209/534
6,378,683 B2 4/2002 Mennie 194/207
6,381,354 B1 4/2002 Mennie et al. 382/135
6,398,000 B1 6/2002 Jenrick et al. 194/200
6,438,230 B1 8/2002 Moore 380/42
6,456,928 B1 * 9/2002 Johnson 701/114
6,459,806 B1 10/2002 Raterman et al. 382/135
6,460,705 B1 10/2002 Hallowell 209/534
6,473,519 B1 10/2002 Pidhirny et al. 382/140
6,474,548 B1 11/2002 Montross et al. 235/379
6,493,461 B1 12/2002 Mennie et al. 382/135
6,539,104 B1 3/2003 Raterman et al. 382/135
6,554,185 B1 4/2003 Montross et al. 235/379
6,560,355 B2 5/2003 Graves et al. 382/135
6,588,569 B1 7/2003 Jenrick et al. 194/206
6,601,687 B1 8/2003 Jenrick et al. 194/206
6,603,872 B2 8/2003 Jones et al. 382/135
6,621,919 B2 9/2003 Mennie et al. 382/135
6,628,816 B2 9/2003 Mennie et al. 382/135
6,636,624 B2 10/2003 Raterman et al. 382/135
6,647,136 B2 11/2003 Jones et al. 382/137
6,650,767 B2 11/2003 Jones et al. 382/135
6,654,486 B2 11/2003 Jones et al. 382/135
6,661,910 B2 12/2003 Jones et al. 382/135
6,665,431 B2 12/2003 Jones et al. 382/135
6,678,401 B2 1/2004 Jones et al. 382/135
6,678,402 B2 1/2004 Jones et al. 382/135

6,705,470 B2 3/2004 Klein et al. ..... 209/534
6,721,442 B1 4/2004 Mennie et al. ..... 382/135
6,724,926 B2 4/2004 Jones et al. ..... 382/135
6,724,927 B2 4/2004 Jones et al. ..... 382/135
6,731,785 B1 5/2004 Mennie et al. ..... 382/135
6,731,786 B2 5/2004 Jones et al. ..... 382/135
6,748,101 B1 6/2004 Jones et al. ..... 382/135
6,758,316 B2 7/2004 Molbak ..... 194/200
6,778,693 B2 8/2004 Jones et al. ..... 382/135
6,783,452 B2 8/2004 Hino et al. ..... 453/3
6,783,785 B1 8/2004 Hino et al. ..... 453/2
6,786,398 B1 9/2004 Stinson et al. ..... 235/379
6,798,899 B2 9/2004 Mennie et al. ..... 382/135
6,810,137 B2 10/2004 Jones et al. ..... 382/135
6,843,418 B2 1/2005 Jones et al. ..... 235/462.01
6,860,375 B2 3/2005 Hallowell et al. ..... 194/207
6,866,134 B2 3/2005 Stromme et al. ..... 194/207
6,868,954 B2 3/2005 Stromme et al. ..... 194/207
6,880,692 B1 4/2005 Mazur et al. ..... 194/207
6,913,130 B1 7/2005 Mazur et al. ..... 194/207
6,913,260 B2 7/2005 Maier et al. ..... 271/265.04
6,915,893 B2 7/2005 Mennie et al.
6,929,109 B1 8/2005 Klein et al. ..... 194/206
6,953,150 B2 * 10/2005 Shepley et al. ..... 235/379
6,955,253 B1 10/2005 Mazur et al. ..... 194/207
6,957,733 B2 10/2005 Mazur et al.
6,959,800 B1 11/2005 Mazur et al. ..... 194/207
6,962,247 B2 11/2005 Maier et al. ..... 194/207
6,980,684 B1 12/2005 Munro et al. ..... 382/135
6,991,530 B2 1/2006 Hino et al. ..... 453/3
6,994,200 B2 2/2006 Jenrick et al. ..... 194/206
6,996,263 B2 2/2006 Jones et al.
7,000,828 B2 2/2006 Jones et al.
7,004,831 B2 2/2006 Hino et al.
7,016,767 B2 3/2006 Jones et al. ..... 700/224
7,028,827 B1 4/2006 Molbak et al.
7,082,216 B2 7/2006 Jones et al. ..... 382/137
7,092,560 B2 8/2006 Jones et al. ..... 382/135
7,103,206 B2 9/2006 Graves et al.
7,103,438 B2 9/2006 Hallowell et al. ..... 700/116
7,113,929 B1 9/2006 Beach et al. ..... 705/65
7,146,245 B2 12/2006 Jones et al. ..... 700/224
7,149,336 B2 12/2006 Jones et al. ..... 382/135
7,158,662 B2 1/2007 Chiles ..... 382/135
7,171,032 B2 1/2007 Jones et al. ..... 382/135
7,187,795 B2 3/2007 Jones et al.
7,191,657 B2 3/2007 Maier et al. ..... 73/587
7,197,173 B2 3/2007 Jones et al. ..... 382/135
7,200,255 B2 4/2007 Jones et al. ..... 382/135
7,201,320 B2 4/2007 Csulits et al. ..... 235/462.01
7,213,697 B2 * 5/2007 Martin et al. ..... 194/317
7,232,024 B2 6/2007 Mazur et al. ..... 194/207
7,248,731 B2 7/2007 Raterman et al. ..... 382/135
7,256,874 B2 8/2007 Csulits et al. ..... 356/71
7,349,566 B2 3/2008 Jones et al.
7,580,859 B2 8/2009 Economy
2001/0006557 A1 7/2001 Mennie et al. ..... 382/135
2001/0015311 A1 8/2001 Mennie ..... 194/207
2001/0019624 A1 9/2001 Raterman et al. ..... 382/135
2001/0035603 A1 11/2001 Graves et al. ..... 271/265.01
2002/0001393 A1 1/2002 Jones et al. ..... 382/100
2002/0020603 A1 2/2002 Jones et al. ..... 194/346
2002/0056605 A1 5/2002 Mazur et al. ..... 194/207
2002/0085245 A1 7/2002 Mennie et al. ..... 358/498
2002/0085745 A1 7/2002 Jones et al. ..... 382/135
2002/0103757 A1 8/2002 Jones et al. ..... 705/45
2002/0104785 A1 8/2002 Klein et al. ..... 209/534
2002/0107801 A1 8/2002 Jones et al. ..... 705/45
2002/0118871 A1 8/2002 Jones et al. ..... 382/137
2002/0122580 A1 9/2002 Jones et al. ..... 382/137
2002/0126885 A1 9/2002 Mennie et al. ..... 382/135
2002/0126886 A1 9/2002 Jones et al. ..... 382/135
2002/0131630 A1 9/2002 Jones et al. ..... 382/137
2002/0136442 A1 9/2002 Jones et al. ..... 382/135
2002/0145035 A1 10/2002 Jones ..... 235/379
2002/0154804 A1 10/2002 Jones et al. ..... 382/135
2002/0154805 A1 10/2002 Jones et al. ..... 382/135
2002/0154806 A1 10/2002 Jones et al. ..... 382/135
2002/0154807 A1 10/2002 Jones et al. ..... 382/135
2002/0154808 A1 10/2002 Jones et al. ..... 382/135
2002/0179401 A1 12/2002 Knox et al. ..... 194/217
2002/0186876 A1 12/2002 Jones et al. ..... 382/135
2003/0004878 A1 * 1/2003 Akutsu et al. ..... 705/43
2003/0009420 A1 1/2003 Jones ..... 705/39
2003/0015395 A1 1/2003 Hallowell et al. ..... 194/206
2003/0015396 A1 1/2003 Mennie ..... 194/206
2003/0062242 A1 4/2003 Hallowell et al. ..... 194/302
2003/0081824 A1 5/2003 Mennie et al. ..... 382/135
2003/0108233 A1 6/2003 Raterman et al. ..... 382/135
2003/0121752 A1 7/2003 Stromme et al. ..... 194/207
2003/0121753 A1 7/2003 Stromme et al. ..... 194/207
2003/0127299 A1 7/2003 Jones et al. ..... 194/217
2003/0132281 A1 7/2003 Jones et al. ..... 235/379
2003/0139994 A1 7/2003 Jones ..... 705/36
2003/0168308 A1 9/2003 Maier et al. ..... 194/207
2003/0174874 A1 9/2003 Raterman et al. ..... 382/135
2003/0182217 A1 9/2003 Chiles ..... 705/35
2003/0198373 A1 10/2003 Raterman et al. ..... 382/135
2003/0202690 A1 10/2003 Jones et al. ..... 382/139
2004/0003980 A1 1/2004 Hallowell et al. ..... 194/206
2004/0016621 A1 1/2004 Jenrick et al. ..... 194/206
2004/0016797 A1 1/2004 Jones et al. ..... 235/379
2004/0028266 A1 2/2004 Jones et al. ..... 382/135
2004/0083149 A1 4/2004 Jones ..... 705/35
2004/0149538 A1 8/2004 Sakowski ..... 194/207
2004/0153408 A1 8/2004 Jones et al. ..... 705/43
2004/0154964 A1 8/2004 Jones ..... 209/534
2004/0173432 A1 9/2004 Jones ..... 194/216
2004/0188221 A1 9/2004 Carter ..... 194/215
2004/0251110 A1 12/2004 Jenrick et al. ..... 194/207
2005/0029168 A1 2/2005 Jones et al. ..... 209/534
2005/0035034 A1 2/2005 Long et al. ..... 209/534
2005/0040225 A1 2/2005 Csulits et al. ..... 235/379
2005/0047642 A1 3/2005 Jones et al. ..... 382/137
2005/0060055 A1 3/2005 Hallowell et al. ..... 700/95
2005/0060059 A1 3/2005 Klein et al. ..... 700/213
2005/0060061 A1 3/2005 Jones ..... 700/226
2005/0077142 A1 4/2005 Tam et al. ..... 194/217
2005/0086271 A1 4/2005 Jones et al. ..... 707/200
2005/0087422 A1 4/2005 Maier et al. ..... 194/207
2005/0108165 A1 5/2005 Jones et al. ..... 705/43
2005/0117791 A2 6/2005 Raterman et al. ..... 382/135
2005/0117792 A2 6/2005 Graves et al. ..... 382/135
2005/0150738 A1 7/2005 Hallowell et al. ..... 194/206
2005/0163361 A1 7/2005 Jones et al. ..... 382/135
2005/0163362 A1 7/2005 Jones et al. ..... 382/137
2005/0169511 A1 8/2005 Jones ..... 382/135
2005/0183928 A1 8/2005 Jones et al. ..... 194/207
2005/0207634 A1 9/2005 Jones et al. ..... 382/135
2005/0213803 A1 9/2005 Mennie et al. ..... 382/135
2005/0241909 A1 11/2005 Mazur et al. ..... 194/207
2005/0249394 A1 11/2005 Jones et al. ..... 382/135
2005/0256792 A1 11/2005 Shimizu et al. ..... 705/35
2005/0265591 A1 12/2005 Jones et al. ..... 382/135
2005/0276458 A1 12/2005 Jones et al. ..... 382/135
2005/0278239 A1 12/2005 Jones et al. ..... 705/35
2006/0010071 A1 1/2006 Jones et al. ..... 705/42
2006/0054455 A1 3/2006 Kuykendall et al. ..... 194/217
2006/0054457 A1 3/2006 Long et al. ..... 194/347
2006/0064379 A1 3/2006 Doran et al. ..... 705/42
2006/0078186 A1 4/2006 Freeman et al. ..... 382/135
2006/0149415 A1 7/2006 Richards ..... 700/236
2006/0182330 A1 8/2006 Chiles ..... 382/135
2006/0195567 A1 8/2006 Mody et al. ..... 709/224
2006/0205481 A1 9/2006 Dominelli ..... 463/25
2006/0207856 A1 9/2006 Dean et al. ..... 193/302
2006/0210137 A1 9/2006 Raterman et al. ..... 382/135
2006/0274929 A1 12/2006 Jones et al. ..... 382/135
2006/0283685 A1 12/2006 Cousin ..... 194/217
2007/0071302 A1 3/2007 Jones et al. ..... 382/135
2007/0076939 A1 4/2007 Jones et al. ..... 382/135
2007/0078560 A1 4/2007 Jones et al. ..... 700/224
2007/0095630 A1 5/2007 Mennie et al. ..... 194/206
2007/0112674 A1 5/2007 Jones et al. ..... 705/45
2007/0122023 A1 5/2007 Jenrick et al. ..... 382/135
2007/0172107 A1 7/2007 Jones et al. ..... 382/137
2007/0221470 A1 9/2007 Mennie et al. ..... 194/216
2007/0237381 A1 10/2007 Mennie et al. ..... 382/135

FOREIGN PATENT DOCUMENTS

| | | | |
|---|---|---|---|
| EP | 0 351 217 | | 1/1990 |
| EP | 0 583 526 | | 2/1994 |
| EP | 0 583 723 | | 2/1994 |
| EP | 0 613 107 | | 8/1994 |
| EP | 0 667 973 | | 1/1997 |
| EP | 0 926 634 | | 6/1999 |
| EP | 1 209 639 | | 5/2002 |
| GB | 2 035 642 | | 6/1980 |
| GB | 2 038 063 | | 7/1980 |
| GB | 2 175 427 | | 11/1986 |
| GB | 2 190 996 | | 12/1987 |
| GB | 2 198 274 | | 6/1988 |
| GB | 2 223 872 | | 4/1990 |
| JP | 52/014495 | | 2/1977 |
| JP | 52/71300 | | 6/1977 |
| JP | 56/40992 | | 4/1981 |
| JP | 62/221773 | | 9/1987 |
| JP | 64/067698 | | 3/1989 |
| JP | 1/307891 | | 12/1989 |
| JP | 02/050793 | | 2/1990 |
| JP | 02/252096 | | 10/1990 |
| JP | 03/012776 | | 1/1991 |
| JP | 3/63795 | | 3/1991 |
| JP | 3/92994 | | 4/1991 |
| JP | 03/156673 | | 7/1991 |
| JP | 04/085695 | | 3/1992 |
| JP | 41/75993 | | 6/1992 |
| JP | 05/274527 | | 10/1993 |
| JP | 06/035946 | | 2/1994 |
| JP | 61/03285 | | 4/1994 |
| JP | 2002/117439 | | 4/2002 |
| WO | WO 85/00909 | | 2/1985 |
| WO | WO 90/07165 | | 6/1990 |
| WO | WO 93/09621 | | 5/1993 |
| WO | WO 93/23824 | | 11/1993 |
| WO | WO 94/06101 | | 3/1994 |
| WO | WO 95/24691 | | 3/1995 |
| WO | WO 96/36933 | | 11/1996 |
| WO | WO 97/43734 | | 11/1997 |
| WO | WO 98/12662 | | 3/1998 |
| WO | WO 98/13785 | | 4/1998 |
| WO | WO 98/24041 | | 6/1998 |
| WO | WO 98/24067 | | 6/1998 |
| WO | WO 98/40839 | | 9/1998 |
| WO | WO 98/47100 | | 10/1998 |
| WO | WO 98/48383 | | 10/1998 |
| WO | WO 98/48384 | | 10/1998 |
| WO | WO 98/48385 | | 10/1998 |
| WO | WO 98/50892 | | 11/1998 |
| WO | WO 98/51082 | | 11/1998 |
| WO | WO 98/59323 | | 12/1998 |
| WO | WO 99/00776 | | 1/1999 |
| WO | WO 99/14668 | | 3/1999 |
| WO | WO 99/23601 | | 5/1999 |
| WO | WO 99/33030 | | 7/1999 |
| WO | WO 99/41695 | | 8/1999 |
| WO | WO 99/48040 | | 9/1999 |
| WO | WO 01/08108 | | 2/2001 |
| WO | WO 01/59685 | | 8/2001 |
| WO | WO 01/59723 | | 8/2001 |
| WO | WO 03/005312 | | 1/2003 |
| WO | WO 03/029913 | | 4/2003 |
| WO | WO 03/030113 | | 4/2003 |
| WO | WO 03/052700 | A2 | 6/2003 |
| WO | WO 03/067532 | | 8/2003 |
| WO | WO 2004/010367 | | 1/2004 |
| WO | WO 2004/027717 | | 4/2004 |
| WO | WO 2004/038631 | | 5/2004 |
| WO | WO 2004/109464 | A3 | 12/2004 |
| WO | WO 2005/017842 | A1 | 2/2005 |
| WO | WO 2005/028348 | A2 | 3/2005 |
| WO | WO 2005/029240 | A2 | 3/2005 |
| WO | WO 2005/036445 | A1 | 4/2005 |
| WO | WO 2006/076289 | A2 | 7/2006 |
| WO | WO 2006/076634 | A2 | 7/2006 |
| WO | WO 2007/035420 | A2 | 3/2007 |

OTHER PUBLICATIONS

Brandt: Model 8904 Upfeed,—High Speed 4-Denomination Currency Dispenser, 2 pages (1989).
Brandt: Model 920/925 Counter, 2 pages (1982).
Brandt: Model 958 Coin Sorter/Counter, 5 pages (© 1982).
Brandt: Model 960 High-Speed Coin Sorter & Counter, 2 pages (1984).
Brandt: Model 970 Coin Sorter and Counter, 2 pages (1983).
Brandt; Model 966 Microsort™ Coin Sorter and Counter, 4 pages, (1979).
Cash, Martin: Newspaper Article "Bank Blends New Technology With Service," Winnipeg Free Press, 1 page (Sep. 4, 1992).
Childers Corporation: Computerized Sorter/Counter, "To coin an old adage, time is money . . . ,"3 pages (1981).
Cummins: JetSort® Model 1701 With Jetstops Coinsorter Operating Instructions Manual (© 1984), 16 pages.
Cummins: JetSort Model CA700-01 Coin Sorter Counter Operating Instructions (© 1982), 14 pages.
Cummins: JetSort Models 701 and 750, "State-of-the-art coin processing comes of age," 2 pages (Feb. 1984).
Declaration of Douglas Mennie (From prosecution history of U.S. Appl. No. 10/198,872).
Diebold: Merchant MicroBranch, "Merchant MicroBranch Combines ATM After-Hour Depository Roll-ed Coin Dispenser," Bank Technology News, 1 page (Nov. 1997).
Glory: CRS-8000 Cash Redemption System, 2 pages (1996).
Royal Bank: Hemeon, Jade, "Royal's Burlington drive-in bank provides customers 24-hour tellers," The Toronto Star, 1 page (Aug. 21, 1991).
Royal Bank: Leitch, Carolyn, "High-Tech Bank Counts Coins," The Globe and Mail, 2 pages (Sep. 19, 1991).
Royal Bank: Oxby, Murray, "Royal Bank Opens 'Super Branch,'" The Gazette Montreal, 2 pages (Sep. 14, 1991).
Royal Bank: SuperBranch, 2 pages (Feb. 1992).
Scan Coin: CDS Coin Deposit System—Technical Referens Manual, 47 pages (1989).
Scan Coin: CDS MK 1 Coin Deposit System—Technical Manual, 32 pages (1991).
Scan Coin: International Report, 49 pages (Apr. 1987).
Scan Coin: World, 2 pages (Feb. 1988).
U.S. Appl. No. 10/084,856 Advisory Action May 9, 2008.
U.S. Appl. No. 10/084,856 Amendment After Final Apr. 30, 2008.
U.S. Appl. No. 10/084,856 Amendment Request Reconsideration, Oct. 30, 2007.
U.S. Appl. No. 10/084,856 Amendment Submitted with CPA RCE, Jun. 4, 2010.
U.S. Appl. No. 10/084,856 Appeal Brief filed Aug. 19, 2008.
U.S. Appl. No. 10/084,856 Appeal filed Affidavit, Sep. 10, 2008.
U.S. Appl. No. 10/084,856 BPAI Decision Examiner Affirmed Dec. 28, 2009.
U.S. Appl. No. 10/084,856 Decision on Reconsideration Denied Apr. 29, 2010.
U.S. Appl. No. 10/084,856 Examiners Answer to Appeal Brief Nov. 21, 2008.
U.S. Appl. No. 10/084,856 Final Rejection, Dec. 31, 2007.
U.S. Appl. No. 10/084,856 Final Rejection Jul. 31, 2007.
U.S. Appl. No. 10/084,856 Pre Brief Appeal Conference Decision, Jun. 19, 2008.
U.S. Appl. No. 10/084,856 Pre Brief Conference Request May 15, 2008.
U.S. Appl. No. 10/084,856 Preliminary Amendment Apr. 11, 2002.
U.S. Appl. No. 10/084,856 Preliminary Amendment, Oct. 23, 2003.
U.S. Appl. No. 10/084,856 Preliminary Amendment, Feb. 27, 2002.
U.S. Appl. No. 10/084,856 Reply Brief filed, Jan. 15, 2009.
U.S. Appl. No. 10/084,856 Reply Brief Noted, Feb. 12, 2009.
U.S. Appl. No. 10/084,856 Request for Continued Examination, Jun. 4, 2010.
U.S. Appl. No. 10/084,856 Request for Hearing BPAI Decision, Mar. 1, 2010.
U.S. Appl. No. 10/084,856 Requirement for Restrictions Apr. 5, 2007.
U.S. Appl. No. 10/084,856 Response to Election Restriction, Apr. 23, 2007.

U.S. Appl. No. 10/198,872 Advisory Action, Jul. 5, 2006.
U.S. Appl. No. 10/198,872 Amendment Requesting Reconsideration, mailed Jun. 13, 2008.
U.S. Appl. No. 10/198,872 Amendment Requesting Reconsideration, mailed Nov. 20, 2007.
U.S. Appl. No. 10/198,872 Amendment Response Jan. 9, 2007.
U.S. Appl. No. 10/198,872 Amendment Response Jun. 29, 2006.
U.S. Appl. No. 10/198,872 Appeal Brief filed, Mar. 1, 2010.
U.S. Appl. No. 10/198,872 Examiners Interview Aug. 1, 2007.
U.S. Appl. No. 10/198,872 Appeal Brief filed, Jun. 15, 2009.
U.S. Appl. No. 10/198,872 Final Office Action Jun. 5, 2007.
U.S. Appl. No. 10/198,872 Final Rejection, Nov. 13, 2008.
U.S. Appl. No. 10/198,872 Office Action dated Mar. 31, 2005.
U.S. Appl. No. 10/198,872 Office Action Mailed Dec. 16, 2004.
U.S. Appl. No. 10/198,872 Office Action Mailed Jul. 29, 2004.
U.S. Appl. No. 10/198,872 Office Action Mailed Oct. 20, 2005.
U.S. Appl. No. 10/198,872 Office Action Mailed Sep. 15, 2006.
U.S. Appl. No. 10/198,872 Office Action Mar. 10, 2006.
U.S. Appl. No. 10/198,872 Reply Brief filed, Dec. 7, 2009.
U.S. Appl. No. 10/198,872 Reply Brief Noted, Jan. 8, 2010.
U.S. Appl. No. 10/198,872 Response to Office Action, Mar. 11, 2005.
U.S. Appl. No. 10/198,872 Response to Office Action, Dec. 22, 2005.
U.S. Appl. No. 10/198,872 Response to Office Action, Aug. 8, 2007.
U.S. Appl. No. 10/198,872 Response to Office Action, Oct. 25, 2004.
U.S. Appl. No. 10/393,867 Notice of Allowance Oct. 19, 2007.
U.S. Appl. No. 10/393,867 Notice of Allowance Sep. 18, 2007.
U.S. Appl. No. 10/393,867 Office Action Mailed Apr. 20, 2007.
U.S. Appl. No. 10/393,867 Office Action Jan. 25, 2007.
U.S. Appl. No. 10/393,867 Response to Office Action Sep. 20, 2006.
U.S. Appl. No. 10/393,867 Office Action Mailed Sep. 20, 2006.
U.S. Appl. No. 10/393,867 Preliminary Amendment Mailed Oct. 16, 2007.
U.S. Appl. No. 10/393,867 Amendment Response After Final Dated Jan. 25, 2007.
U.S. Appl. No. 10/393,867 Final Office Action Mailed Jan. 25, 2007.
U.S. Appl. No. 11/434,092 Amendment After Final Office Action Nov. 23, 2009.
U.S. Appl. No. 11/434,092 Amendment After Notice of Allowance Mar. 8, 2010.
U.S. Appl. No. 11/434,092 Amendment Request Non Final Rejection Jun. 19, 2009.
U.S. Appl. No. 11/434,092 Amendment Request Non Final Rejection Nov. 20, 2008.
U.S. Appl. No. 11/434,092 Final Rejection Action Oct. 6, 2009.
U.S. Appl. No. 11/434,092 Non Final Rejection Mar. 19, 2009.
U.S. Appl. No. 11/434,092 Non Final Rejection Aug. 21, 2008.
U.S. Appl. No. 11/434,092 Notice of Allowance Fees Mar. 22, 2010.
U.S. Appl. No. 11/434,092 Notice of Allowance Fees May 27, 2010.
U.S. Appl. No. 11/434,092 Notice of Allowance Jan. 4, 2010.
U.S. Appl. No. 11/434,092 Request for Continued Examination Feb. 9, 2010.
U.S. Appl. No. 11/434,092 Request for Continued Examination May 14, 2010.
U.S. Appl. No. 11/726,828 Pre/Exam Formalities Notice May 1, 2007.
U.S. Appl. No. 11/726,828 Amendment Reconsideration After Non/Final Sep. 2, 2009.
U.S. Appl. No. 11/726,828 Amendment Reconsideration After Non/Final Mar. 24, 2010.
U.S. Appl. No. 11/726,828 Application Response to Pre Exam Formalities, Jun. 29, 2007.
U.S. Appl. No. 11/726,828 Non Final Rejection Apr. 2, 2009.
U.S. Appl. No. 11/726,828 Final Rejection Jun. 16, 2010.
U.S. Appl. No. 11/726,828 Non Final Rejection Dec. 8, 2009.
U.S. Appl. No. 11/726,828 Response to Election Restriction filed Feb. 25, 2009.
U.S. Appl. No. 11/726,828 Notice of Appeal filed Sep. 16, 2010.
U.S. Appl. No. 11/803,281 Advisory Action, Aug. 12, 2009.
U.S. Appl. No. 11/803,281 Affidavit/Dec Exhibit After Notice of Appeal, Nov. 5, 2009.
U.S. Appl. No. 11/803,281 Appeal Brief filed, Nov. 5, 2009.
U.S. Appl. No. 11/803,281 Applicant Argument Remarks Made in Amendment, Feb. 12, 2009.
U.S. Appl. No. 11/803,281 Applicant Arguments Remarks Made in Amendment Jan. 20, 2009 9pages.
U.S. Appl. No. 11/803,281 Applicant Arguments Remarks Made in Amendment May 14, 2007 1 page.
U.S. Appl. No. 11/803,281 Application Arguments Remarks Made in Amendment, Jul. 24, 2009.
U.S. Appl. No. 11/803,281 Notice of Appeal Aug. 13, 2009.
U.S. Appl. No. 11/803,281 Notice to Applicant Regarding Non Compliant, Feb. 2, 2009.
U.S. Appl. No. 11/803,281 Final Rejection Apr. 23, 2009.
U.S. Appl. No. 11/803,281 Preliminary Amendment, May 14, 2007.
U.S. Appl. No. 11/803,281 Non/Final Rejection, Oct. 17, 2008.
U.S. Appl. No. 11/803,365 Amendment Reconsideration After Non/Final, Jan. 21, 2009.
U.S. Appl. No. 11/803,365 Amendment Reconsideration After Non/Final, Jul. 14, 2009.
U.S. Appl. No. 11/803,365 Applicant Response to Pre/Exam Formalities, Aug. 17, 2007.
U.S. Appl. No. 11/803,365 Appeal Brief filed Apr. 8, 2010.
U.S. Appl. No. 11/803,365 Appeal Docketing Notice Sep. 3, 2010.
U.S. Appl. No. 11/803,365 Examiners Answer to Appeal Brief Jul. 6, 2010.
U.S. Appl. No. 11/803,365 Final Rejection, Nov. 9, 2009.
U.S. Appl. No. 11/803,365 Non/Final Rejection, Apr. 14, 2009.
U.S. Appl. No. 11/803,365 Non/Final Rejection, Oct. 20, 2008.
U.S. Appl. No. 11/803,365 Notice of Appeal filed Feb. 8, 2010.
U.S. Appl. No. 11/803,365 Pre Exam Formalities Notice Jun. 12, 2007.
U.S. Appl. No. 11/803,365 Preliminary Amendment Aug. 17, 2007.
U.S. Appl. No. 11/803,365 Preliminary Amendment Applicant Arguments May 14, 2007.
U.S. Appl. No. 11/803,365 Reply Brief filed Jul. 23, 2010.
U.S. Appl. No. 11/803,365 Reply Brief Noted Aug. 20, 2010.
U.S. Appl. No. 11/803,366 Advisory Action Aug. 10, 2009.
U.S. Appl. No. 11/803,366 Appeal Docketing Notice, Jul. 22, 2010.
U.S. Appl. No. 11/803,366 Reply Brief filed, Apr. 20, 2010.
U.S. Appl. No. 11/803,366 Reply Brief Noted, Jul. 7, 2010.
U.S. Appl. No. 11/803,366 Affidavit Dec/Exhibit After Notice of Appeal, Oct. 8, 2009.
U.S. Appl. No. 11/803,366 Amendment After Final Jul. 20, 2009.
U.S. Appl. No. 11/803,366 Amendment Request Reconsideration After Non Final Rejection, Jan. 23, 2009.
U.S. Appl. No. 11/803,366 Appeal Brief Field Nov. 16, 2009.
U.S. Appl. No. 11/803,366 Appeal Brief filed Oct. 8, 2009.
U.S. Appl. No. 11/803,366 Final Rejection Apr. 20, 2009.
U.S. Appl. No. 11/803,366 Non/Final Rejection Sep. 23, 2008.
U.S. Appl. No. 11/803,366 Notice of Appeal filed Aug. 11, 2009.
U.S. Appl. No. 11/803,366 Preliminary Amendment May 14, 2007.
U.S. Appl. No. 11/803,366 Examiners Answer to Appeal Brief, Mar. 2, 2010.
U.S. Appl. No. 11/803,381 Amendment Reconsideration After Non/Final Rejection, Jan. 23, 2009.
U.S. Appl. No. 11/803,381 Amendment Reconsideration After/Non Final Rejection, Jan. 27, 2010.
U.S. Appl. No. 11/803,381 Amendment Request Reconsideration After Non final Mailed Jul. 21, 2010.
U.S. Appl. No. 11/803,381 Amendment Submitted Entered With Filing of CPA/RCE, Jun. 30, 2009.
U.S. Appl. No. 11/803,381 Final Rejection, Mar. 30, 2009.
U.S. Appl. No. 11/803,381 Non/Final Rejection, Apr. 23, 2010.
U.S. Appl. No. 11/803,381 Non/Final Rejection, Aug. 12, 2009.
U.S. Appl. No. 11/803,381 Non/Final Rejection, Sep. 24, 2008.
U.S. Appl. No. 11/803,381 Request for Continued Examination Amendment Submitted Jun. 30, 2009.
U.S. Appl. No. 11/803,381 Response to Pre Exam Formalities Notice Aug. 17, 2007.

* cited by examiner

COIN PROCESSING DEVICE HAVING A MOVEABLE COIN RECEPTACLE STATION

CROSS-REFERENCE TO RELATED APPLICATIONS

This application claims the benefit of the U.S. Provisional Application 60/735,783 filed on Nov. 12, 2005 entitled "Coin Processing Device Having A Removeable Coin Receptacle Station" and U.S. Provisional Application 60/735,782 filed on Nov. 12, 2005 entitled "Coin Processing Machine" and both provisional applications are hereby incorporated by reference in their entirety.

FIELD OF THE INVENTION

The present invention relates generally to coin processing devices including coin redemption machines.

BACKGROUND OF THE INVENTION

Coin processing machines are used both in the financial industry to sort, count, and/or package coins and in the retail sector as a publicly-accessible redemption machine to exchange loose change for a ticket or voucher.

In some conventional coin processing machines, each of a plurality of valid coin denominations are separated from the remaining denominations and stored in a receptacle specific to that denomination. A disadvantage to this approach is that as soon as a receptacle for a single denomination becomes full, the entire machine must be shut down until the receptacle can be changed. To mitigate this disadvantage, some machines permit the assignment of an additional bag to a commonly received denomination. However, in many instances, the exact mix of coins received over any given period of time cannot be accurately predicted and this does not cure the spatial limitations associated with this type of coin processing machine.

In some other conventional coin processing machines, the sorted coins are collected in a large bulk coin bin. Although the large bulk coin bin maximizes the availability of the coin processing machine from the perspective of having sufficient available volume to output the processed coins, the use of large bulk coin bins brings with it its own disadvantages. The large bulk coin bins weigh hundreds of pounds when full and require specialized equipment, such as a truck with a lift gate, and collection services, each of which adds to the cost and maintenance of the coin processing machine.

Still another conventional processing machine utilizes up to six coin bags of mixed coins. One example of this is the Magner Coinstream® Model No. CDS 524, which permits 6 or bags of coins. The DeLaRue CDS3010 also claims to provide up to four bagging attachments in lieu of a bin. However, these approaches, although seeking to address some of the issues noted above, have not found support in the marketplace and fails to provide a capacity approaching that of a bin.

A need exists for improved coin processing and management systems avoiding the above-described problems.

SUMMARY OF THE INVENTION

In one aspect, the present concepts include a coin processing system comprises a coin processing machine configured to receive a plurality of randomly oriented coins in a coin input region thereof, process the coins, and determine a total amount of the coins. The coin processing system also comprises at least one sensor configured to measure a pre-determined property associated with a component of the coin processing machine or an operational state of the coin processing machine and to output to a controller a signal related thereto and at least one actuating device disposed to influence the pre-determined property. A controller is configured to monitor the signal output by the sensor(s) and, responsive to a deviation of a value of the signal from an acceptable value for the signal, to execute an error recovery instruction set at least once. Execution of the error recovery instruction set by the controller causes an actuation of the actuating device(s) to influence the pre-determined property to attempt to restore the operational parameter to a condition wherein the signal output by the sensor(s) is within an acceptable value for the pre-determined property.

In another aspect of the present concepts, a method for automated error recovery in a coin processing system, comprises the acts of providing a coin processing machine configured to receive a plurality of randomly oriented coins in a coin input region thereof, process the coins, and determine a total amount of the coins. The method also includes the acts of measuring a pre-determined property associated with a component of the coin processing machine or an operational state of the coin processing machine using a sensor, outputting a signal from the sensor to a controller, and executing an error recovery instruction set at least once responsive to a deviation of a value of the signal from an acceptable value for the signal.

In yet another aspect of the present concepts, a coin processing system comprises a coin processing machine comprising a coin input region, a coin module including configured to receive coins input into the coin input region, to process the coins, and to determine a total amount of the coins, and to output the coins to at least one coin receptacle. The coin processing system also includes a sensor disposed configured to measure a parameter associated with the coin processing system and output to a controller a signal relating to the measured parameter and a controller configured to process the signal relating to the measured parameter and to output data relating to the parameter to a memory, the controller being further configured to retrieve the data from the memory and to trend the data relating to the parameter.

In still another aspect of the present concepts, a method for storing and utilizing data relating to a coin processing system comprises the act of processing a plurality of coins, the act of processing comprising receiving coins in a coin input region, determining a total amount of the coins, and outputting the coins to at least one coin receptacle. The method also includes periodically monitoring a coin processing system component or a coin processing system sensor, storing data relating to the act of monitoring, and trending the stored data for a respective one of the coin processing system component or coin processing system sensor. The method also includes modifying, in accord with an instruction set, a coin processing system variable and/or a sensor variable responsive to the act of trending.

The presently disclosed concepts are not intended to represent each embodiment, or every aspect, of the present invention. Additional features and benefits of the present invention are apparent from the detailed description, figures, and embodiments set forth below.

Figure 1:
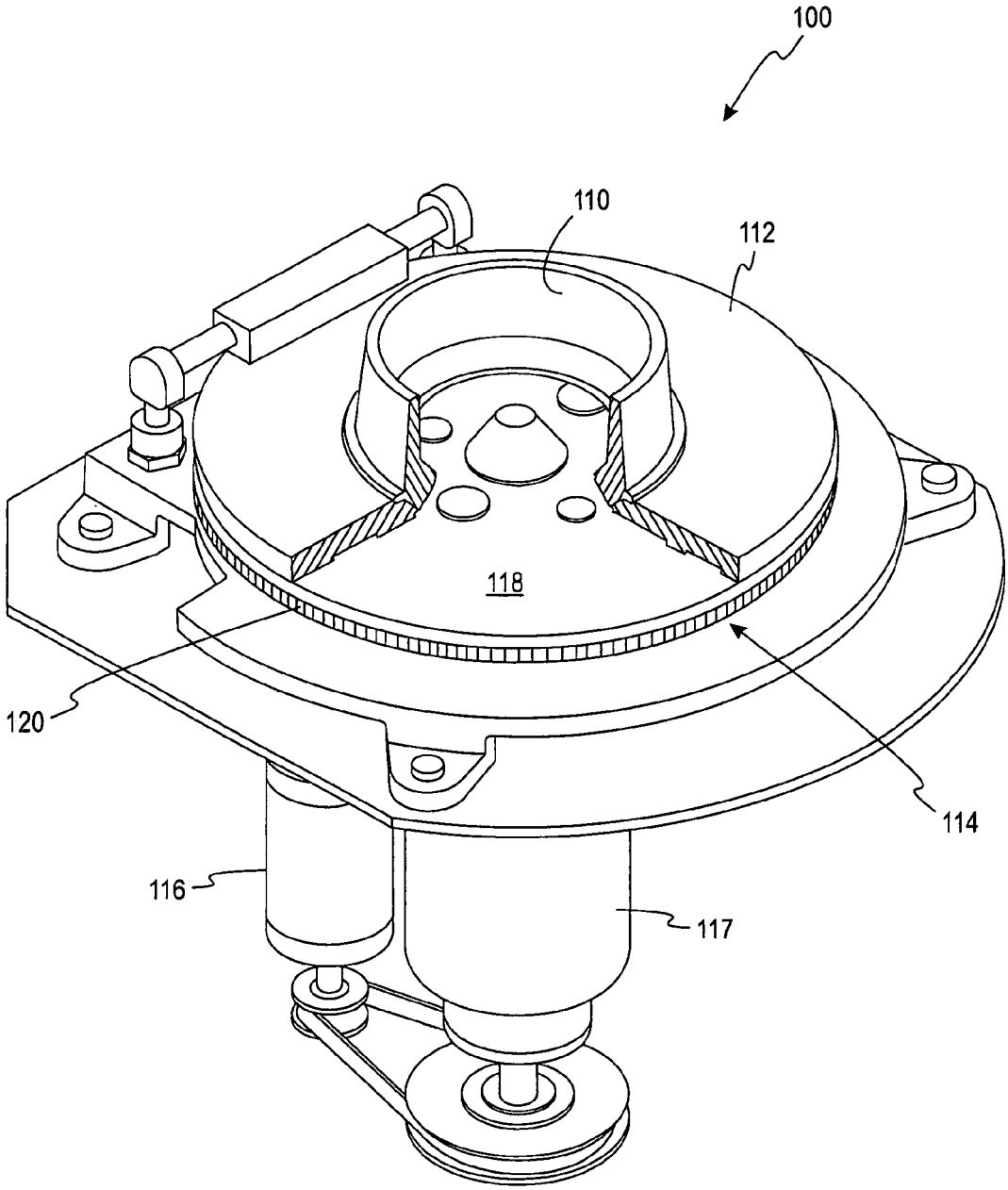
FIG. 1 is a perspective view of a disk-type coin processing unit, having portions thereof broken away to show the internal structure, for use with the coin processing device in accord with at least some embodiments of the present concepts.

While the invention is susceptible to various modifications and alternative forms, specific embodiments are shown by way of example in the drawings and will be described in detail herein. It should be understood, however, that the invention is not intended to be limited to the particular forms disclosed.

DETAILED DESCRIPTION OF THE ILLUSTRATED EMBODIMENTS

FIG. 1 shows a disk-type coin processing unit 100 that is used in coin processing devices according to at least some embodiments of the present invention. The coin processing unit 100 includes a hopper 110 for receiving coins of mixed denominations from a coin input and feeds the coins through a central opening in an annular, stationary sorting head 112. As the coins pass through this opening, the coins are deposited on the top surface of a rotatable disk 114. This rotatable disk 114 is mounted for rotation on a shaft (not shown) and driven by an electric motor 116. The rotation of the rotatable disk 114 is slowed and stopped by a breaking mechanism 117. The disk 114 typically comprises a resilient pad 118, preferably made of a resilient rubber or polymeric material, bonded to the top surface of a solid disk 120. The solid disk 120 is often made of metal, but it can also be made of a rigid polymeric material. According to one embodiment, coins are initially deposited by a user into a coin tray disposed above the coin processing unit 100 and coins flow into the hopper 110 under the force of gravity.

As the disk 114 is rotated, the coins deposited on the resilient pad 118 tend to slide outwardly over the surface of the pad 118 due to centrifugal force. As the coins move outwardly, those coins that are lying flat on the pad 118 enter the gap between the surface of the pad 118 and the sorting head 112 because the underside of the inner periphery of the sorting head 112 is spaced above the pad 118 by a distance which is about the same as the thickness of the thickest coin. As is further described below, the sorting head 112 includes a plurality of coin directing channels for manipulating the movement of the coins from an entry area to a plurality of exit stations where the coins are discharged. The coin exit stations may sort the coins into their respective denominations and discharge the coins from exit channels in the sorting head 112 corresponding to their denominations.

Figure 2:
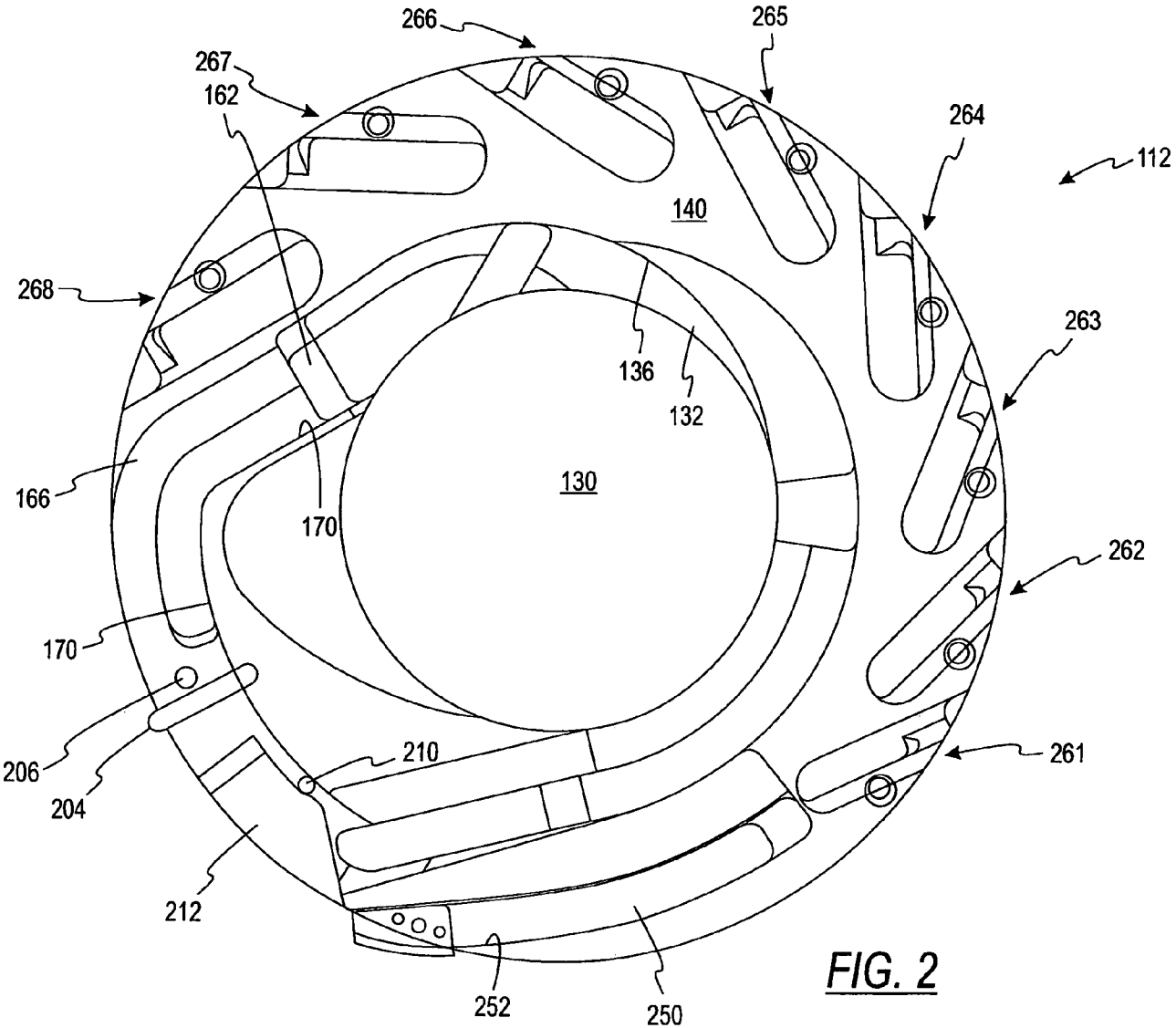
FIG. 2 is an enlarged bottom view of a sorting head for use with the coin processing unit of FIG. 1.

Referring now to FIG. 2, the underside of the sorting head 112 is shown. The coin sets for any given country are sorted by the sorting head 112 due to variations in the diameter size. The coins circulate between the stationary sorting head 112 and the rotating pad 118 on the rotatable disk 114, shown in FIG. 2. The coins are deposited on the pad 118 via a central opening 130 and initially enter the entry channel 132 formed in the underside of the sorting head 112. It should be kept in mind that the circulation of the coins in FIG. 2 appears counterclockwise as FIG. 1 is a view of the underside of the sorting head 112.

An outer wall 136 of the entry channel 132 divides the entry channel 132 from the lowermost surface 140 of the sorting head 112. The lowermost surface 140 is preferably spaced from the pad 118 by a distance that is slightly less than the thickness of the thinnest coins. Consequently, the initial outward radial movement of all the coins is terminated when the coins engage the outer wall 136, although the coins continue to move more circumferentially along the wall 136 (in the counterclockwise direction as viewed in FIG. 2) by the rotational movement imparted to the coins by the pad 118 of the rotatable disk 114.

As the pad 118 continues to rotate, those coins that were initially aligned along the wall 136 move across the ramp 162 leading to the queuing channel 166 for aligning the innermost edge of each coin along an inner queuing wall 170. The coins are gripped between the queuing channel 166 and the pad 118 as the coins are rotated through the queuing channel 166. The coins, which were initially aligned with the outer wall 136 of the entry channel 130 as the coins move across the ramp 162 and into the queuing channel 166, are rotated into engagement with inner queuing wall 170. As the pad 118 continues to rotate, the coins which are being positively driven by the pad move through the queuing channel 166 along the queuing wall 170 past a trigger sensor 206 and a discrimination sensor 204 for discriminating between valid and invalid coins. In other embodiments, the discrimination sensor 204 also determines the denomination of the coins. The trigger sensor 206 sends a signal to the discrimination sensor 204 that a coin is approaching.

Coins determined to be invalid are rejected by a diverting pin 210 that is lowered and impacts an invalid coin to redirect the invalid coin to the reject channel 212 which guides the rejected coins to a reject chute (not shown) that return the coin to the user. The diverting pin 210 remains in its home, or nondiverting position, until an invalid coin is detected. Those coins not diverted into the reject channel 212 continue along inner queuing wall 170 to the gauging region 250. The inner queuing wall 170 terminates just downstream of the reject channel 212; thus, the coins no longer abut the inner queuing wall 170 at this point and the queuing channel 166 terminates. The radial position of the coins is maintained, because the coins remain under pad pressure, until the coins contact an outer wall 252 of the gauging region 250.

The gauging wall 252 aligns the coins along a common radius as the coins approach a series of coin exit channels 261-268 which discharge coins of different denominations. The first exit channel 261 is dedicated to the smallest coin to be sorted (e.g., the dime in the U.S. coin set). Beyond the first exit channel 261, the sorting head 112 shown in FIG. 2 forms seven more exit channels 262-268 which discharge coins of different denominations at different circumferential locations around the periphery of the sorting head 112. Thus, the exit channels 261-268 are spaced circumferentially around the outer periphery of the sorting head 112 with the innermost edges of successive channels located progressively closer to the center of the sorting head 112 so that coins are discharged in the order of increasing diameter. The number of exit channels can vary according to alternative embodiments of the present invention.

The innermost edges of the exit channels 261-268 are positioned so that the inner edge of a coin of only one particular denomination can enter each channel 261-268. The coins of all other denominations reaching a given exit channel extend inwardly beyond the innermost edge of that particular exit channel so that those coins cannot enter the channel and, therefore, continue on to the next exit channel under the circumferential movement imparted on them by the pad 118.

To maintain a constant radial position of the coins, the pad 118 continues to exert pressure on the coins as they move between successive exit channels 261-268.

Further details of the operation of the sorting head 112 shown in FIG. 2 are disclosed in U.S. Patent Application Publication No. US 2003/0168309 A1 ("Disk-Type Coin Processing Device Having Improved Coin Discrimination System"), which is incorporated herein by reference in its entirety. Other disk-type coin processing devices suitable for use with the coin processing device disclosed herein are shown in U.S. Pat. Nos. 6,755,730; 6,637,576; 6,612,92; 6,039,644; 5,997,395; 5,865,673; 5,782,686; 5,743,373; 5,630,494; 5,538,468; 5,507,379; 5,489,237; 5,474,495; 5,429,550; 5,382,191; and 5,209,696, each of which is incorporated herein by reference in its entirety.

Figure 3B:
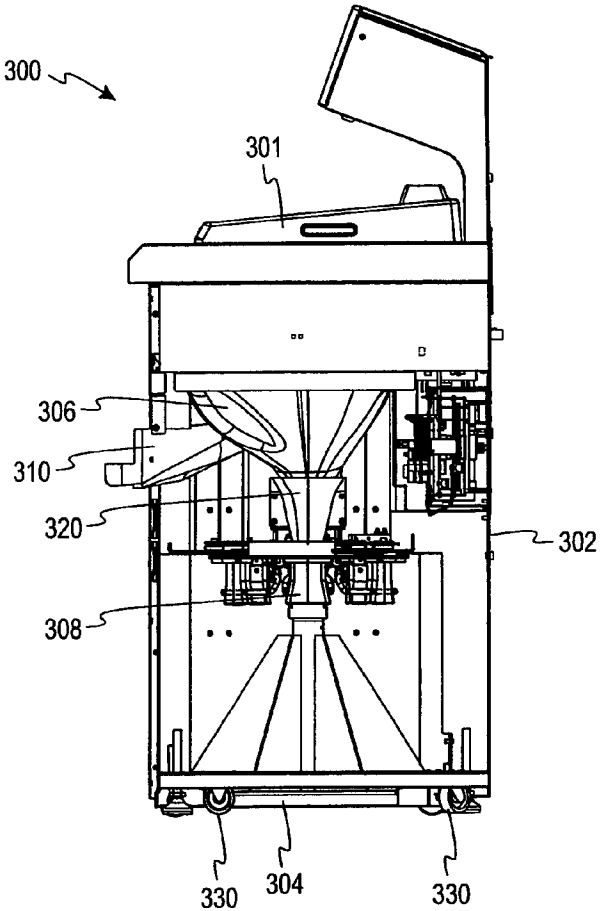
FIGS. 3(*a*)-(*b*) is a perspective view of a coin processing device in accord with least some embodiments of the present concepts.
Figure 3A:
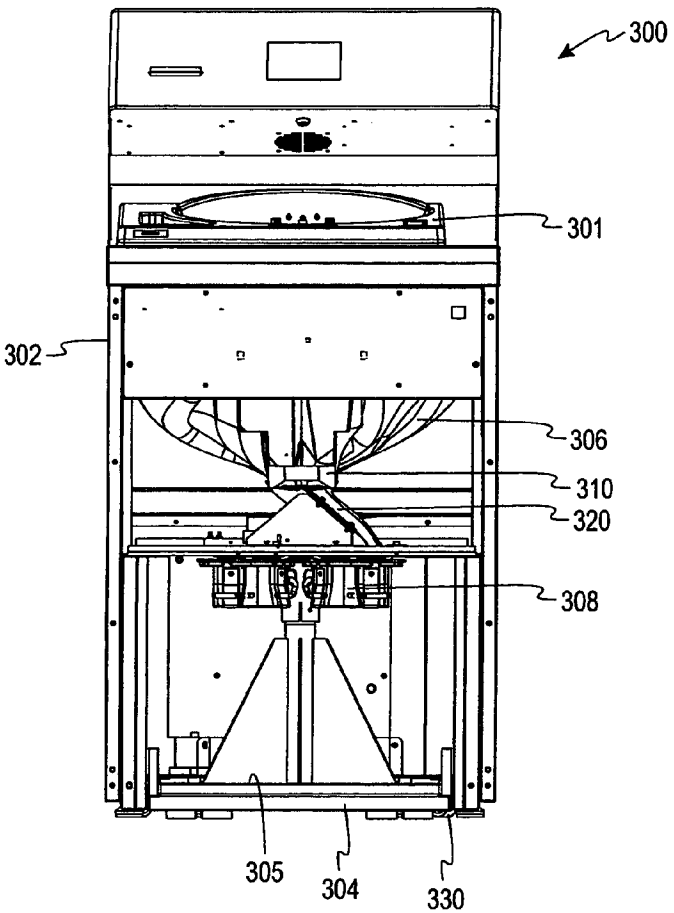

FIG. 3(*a*) shows a perspective view of a coin processing machine 300 having a coin-storage system in accord with at least some aspects of the present concepts is presented. The coin processing machine 300 may comprise, in one aspect, a retail or self-service coin redemption machine.

The coin processing machine 300 includes a housing 302 that contains a coin processing unit (not shown), such as that described with respect to FIGS. 1-2. Also disposed within the housing 302 is a receptacle station 304 that is translatable and/or rotatable with respect to the housing 302 to permit an operator to access each coin receptacle station and coin receptacle associated therewith (e.g., coin bags, trays, cassettes, canisters, bins, etc.). The receptacle station 304 has a home position defined by a specified position and rotation of the receptacle station within the housing 302. Guides (not shown) are advantageously provided to ensure proper placement of the receptacle station 304 within the housing 302. The home position used for docking may also correspond to contact and/or connector placement to form electrical connections between contacts and/or connectors on the receptacle station 304 and corresponding contacts and/or connectors on the housing 302. Such electrical connections may be used, for example, to charge a battery on the receptacle station 304.

In at least some aspects of the present concepts, the coin receptacle is a coin bag and the receptacle station comprises receptacle holders 308 that are coin bag holders. One example of a suitable bag holder suitable for use with coin bags is described in U.S. Pat. No. 6,131,625, which is incorporated herein by reference in its entirety. The open end of a coin bag or other receptacle is attached to the receptacle holder 308, while the closed end of the receptacle (e.g., coin bag) may rest on a platform or lower surface 305 of the receptacle station 304. The platform 305 may be optionally adjustable to permit changes to the distance between the platform 305 and the coin collector 306 to accommodate coin receptacles of different sizes.

As noted above, in at least some embodiments, the receptacle station 304 may be translated into and out of the housing 302. In the embodiment shown in FIGS. 3(*a*)-(*b*), wheels 330 are provided to permit this movement. However, other conventional devices to permit translation may also be used including, but not limited to, rollers, casters, glide units, railings, tracks, rails, or slideable drawers. In alternative embodiments, the receptacle station may be substantially fixed or locked against translational movement, but may be rotated to permit sequential access for an operator to the coin receptacles. Since at least some of the embodiments of the present concepts include embodiments wherein mixed coins are input to each of the coin receptacles, As shown in FIGS. 3(*a*)-(*b*), the receptacle station 304 is disposed on wheels 330 for facilitating the movement of the receptacle station 304 into and out of the housing 302. A damping mechanism may optionally be attached to the receptacle station 304 for limiting a speed at which the receptacle station 304 travels into and out of the housing 302. In such embodiment, a first end of the damping mechanism is coupled to the coin receptacle station 304 and a second end of the damping mechanism is coupled to the housing 302. When heavily loaded, the amount of weight traveling with the receptacle station 304 is considerable. The damping mechanism, such as an air cylinder, prevents the moveable receptacle station 304 from traveling too rapidly into and out of the housing 302. The receptacle station 304 is also preferably tethered to the housing and/or other aspects of the coin processing device by an energy chain cable carrier, such as that manufactured by Igus Corp. The energy chain guides and protects cables and prevents tangling and wear. The removable cart may alternatively comprise an optional resident battery for temporarily powering sensors, components, lights, and/or transmitters (e.g., RF transmitter) on the receptacle station 304 when the receptacle station is undocked.

The moveable receptacle station 304 facilitates operator access to the coin receptacles. In operation, the receptacle station 304 is moved into the housing 302 of the coin processing machine 300 and a door 321 prevents unauthorized access to the coin receptacles. At certain times or upon the occurrence of certain events, such as a coin minimum number of mixed coin coin receptacles becoming filled (e.g., all but one or all), an operator may accesses the coin receptacles. In doing so, the operator opens the door 321 and moves the coin receptacle station 304 in accord with its configuration (e.g., translating the coin receptacle station 304 outwardly or rotating the coin receptacle station to successive coin receptacles).

In one embodiment of the present concepts, coin receptacles may comprise bins or used for holding sorted coins. The coin bins or boxes may be attached to the receptacle holder 308 or may be disposed on the platform 310 of the coin receptacle station 304. Alternatively still, coin bags may line the coin bins.

Figure 4:
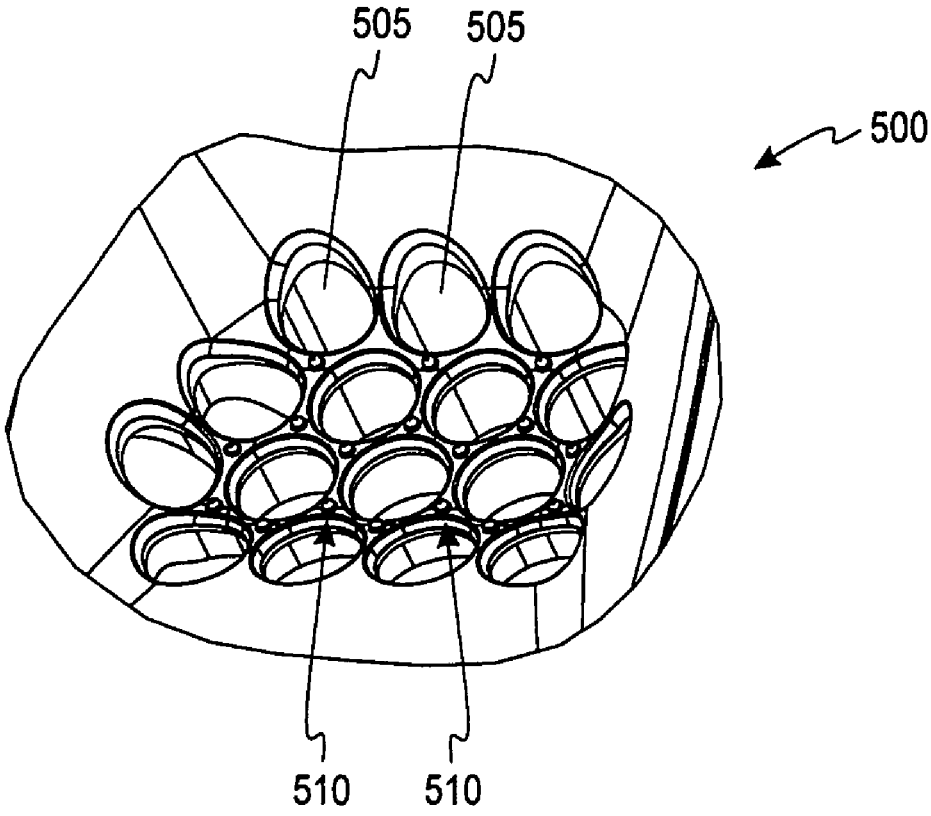
FIG. 4 is an example of a coin-in module which may be used in the coin processing device of FIGS. 3(*a*)-(*b*) in accord with least some embodiments of the present concepts.
Figure 5A:
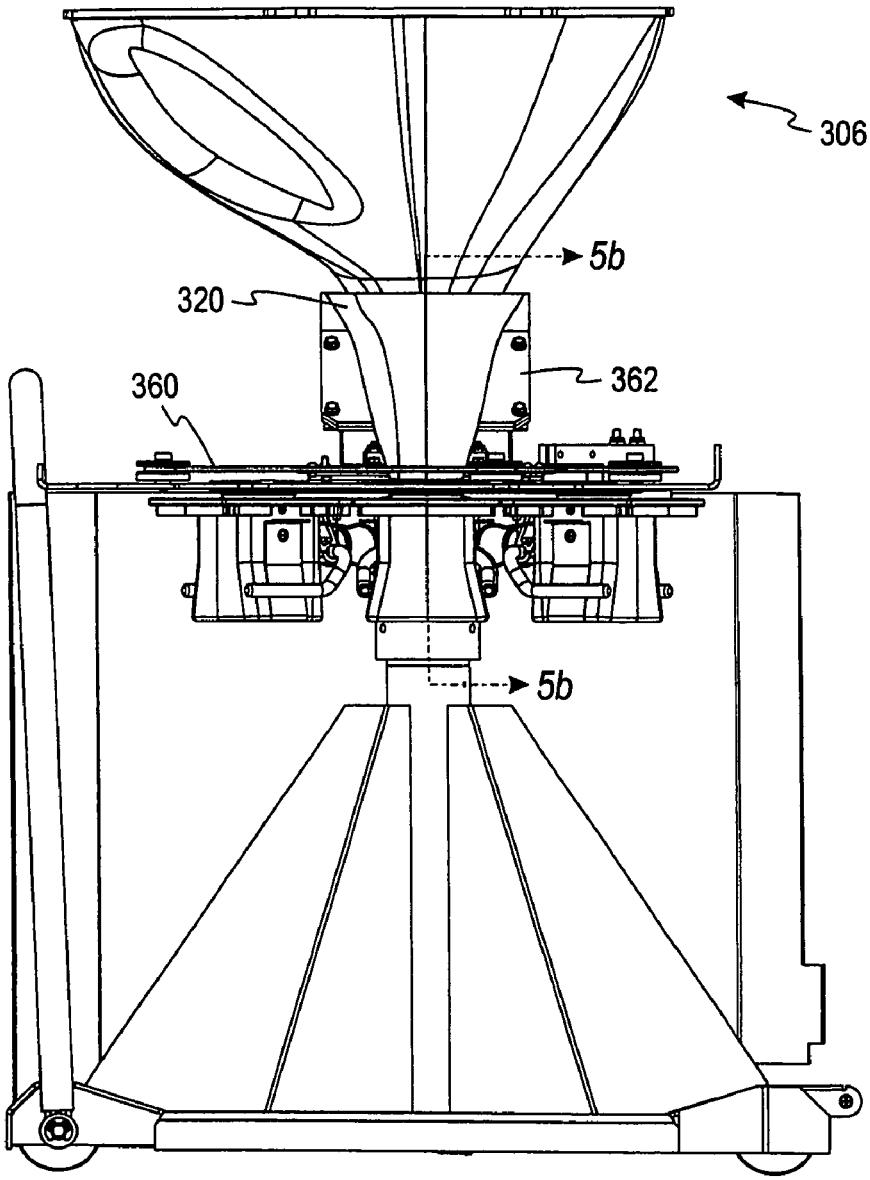
FIG. 5(*a*)-(*e*) are views of the coin processing device of FIGS. 3(*a*)-(*b*).
Figure 5B:
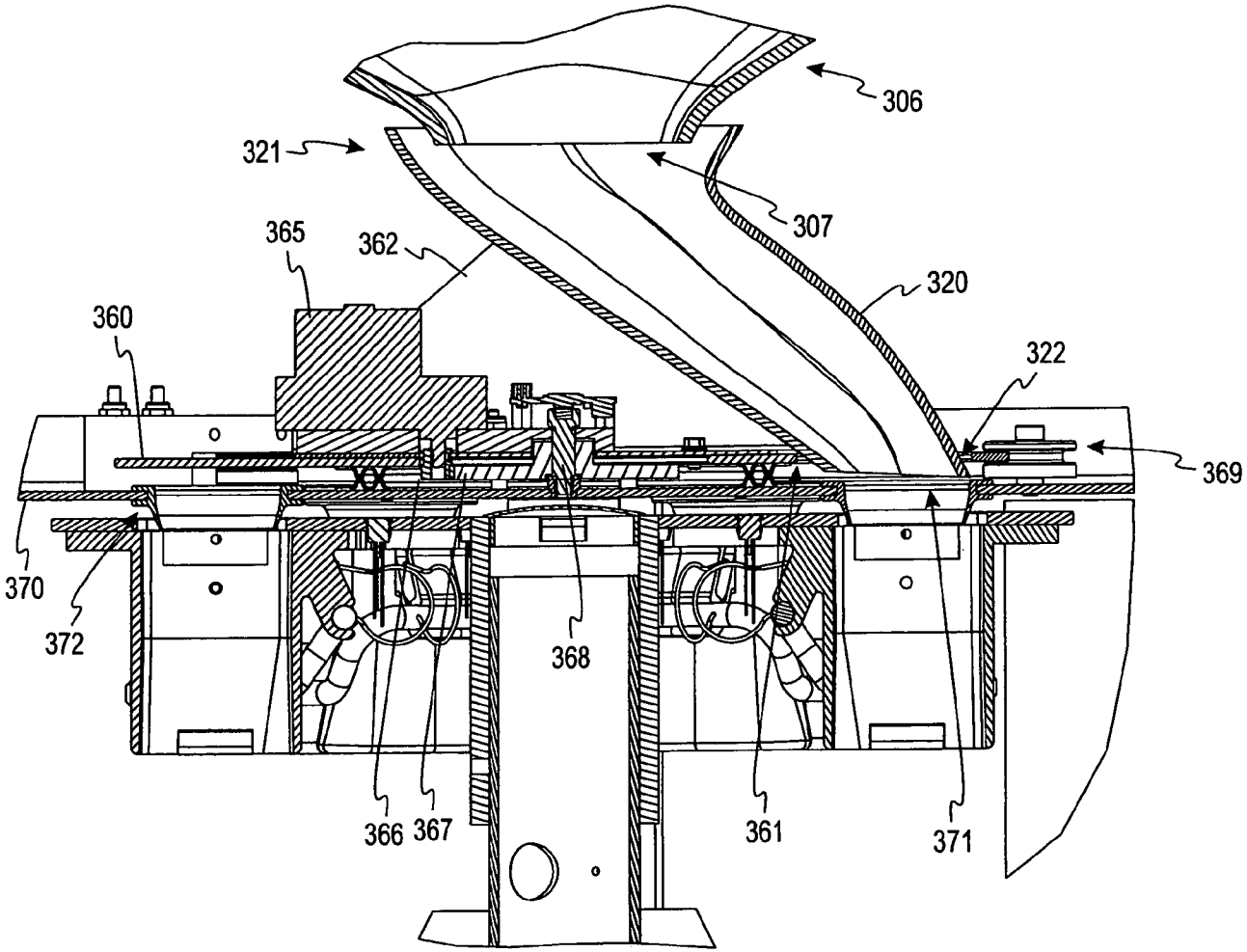
Figure 5C:
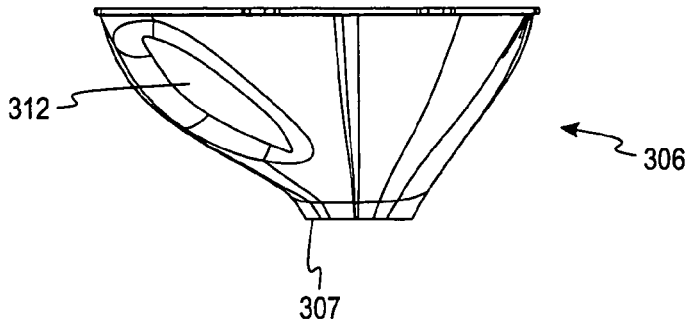
Figure 5D:
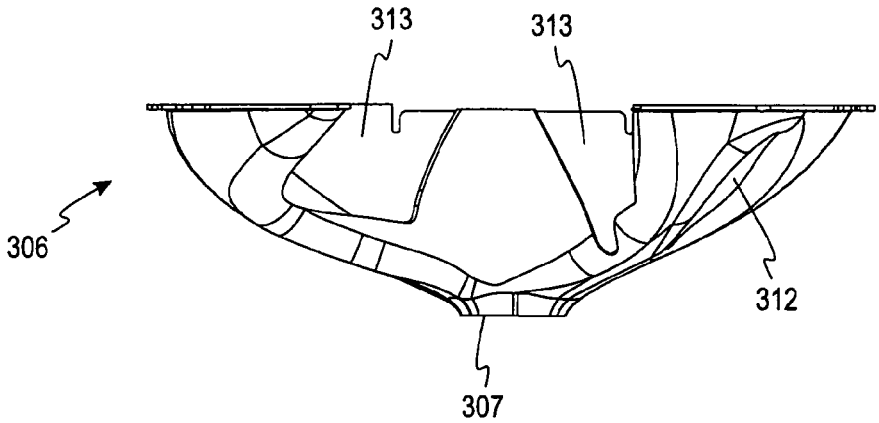
Figure 5E:
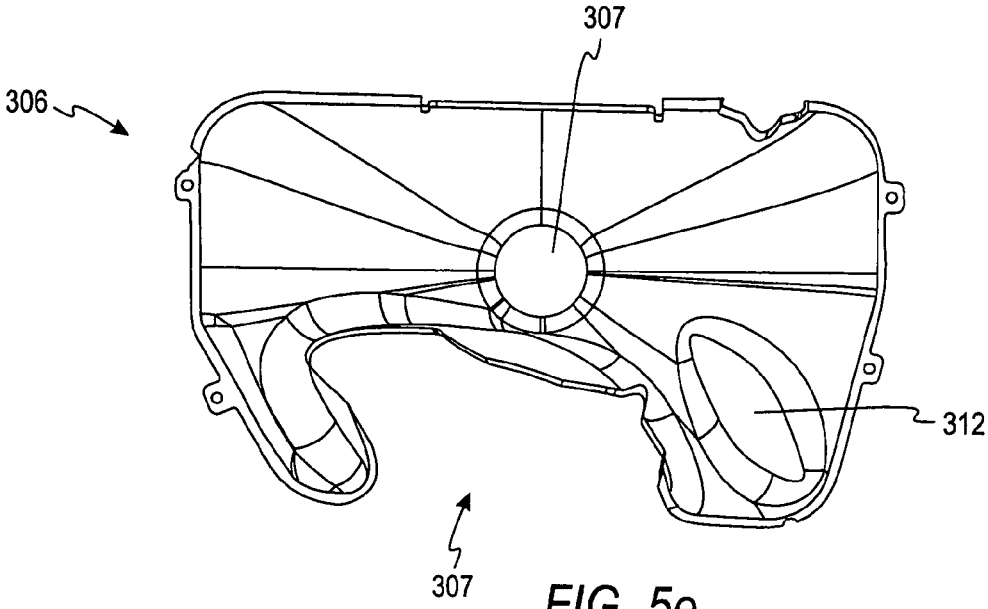

FIG. 4 shows a perspective partial view of one embodiment of coin tray or coin-in module 301 suitable for use with the coin processing device shown in FIGS. 3(*a*)-(*b*). Any shape and/or type of coin-in module, coin-in bowl, or coin-in tray may also be used in accord with the concepts disclosed herein, examples of which may be found in the various patents incorporated by reference herein, noted above. The coin-in module 301 optionally includes coin jostle bumps 350, such as is shown in FIG. 4. A plurality of coin openings 340 are provided in the coin-in module 301 to permit the passage of coins. To avoid the problem of coins being stalled or balanced on an edge between two or three adjacent coin openings 340, in the configuration depicted, coin jostle bumps 350 may be added, such as shown. These coin jostle bumps 350 force coins which might have otherwise been stalled or balanced on an edge between two or three adjacent openings into a tilted and unstable orientation so that no coins will remain stuck in the coin-in module, thus avoiding the need for the user to manually swish or move the coins into the coin openings 340. Although depicted as being provided only at the flat of intersection between three adjacent coin openings 340, these coin jostle bumps 350 may also be provided on the edges between two adjacent coin openings. The coin jostle bumps 350 may comprise a variety of shapes (e.g., hemispherical, frustoconical, square, cylindrical, conical, etc.) and a variety of heights (e.g., between about 0.10"-0.25", between about 0.25"-0.50", etc.). Moreover, a variety of different combinations of shapes, sizes, and positions of the coin jostle bumps 350 may be provided. For example, hemispherical coin jostle bumps 350 could be provided at the intersections of three adjacent coin openings 340, while smaller triangular, conical or wedge-shaped coin jostle bumps could be provided on edged between two adjacent coin openings. The coin jostle bumps 350 include, but are not limited to, any projecting shape of sufficient height to tilt a coin sufficiently to, in combination with sliding coefficient of friction of the selected material, and more preferably the static coefficient of friction of the selected material, bias the coin to an unstable position from which it inevitably must slide toward and into the coin opening 340. Thus, surfaces having lower coefficients of friction may utilize smaller coin jostle bumps 350 than those surfaces having comparatively higher coefficients of friction. The distance between the edges of the openings 340 and the coin jostle bumps 350 is also presently considered to be a factor in determining an appropriate height for the coin jostle bumps.

The coin collector 306 is disposed to receive all coins discharged by the coin exit channels 261-268 of the sorting head 112 (FIG. 2) and to funnel them to a distribution outlet 307. A separate coin collector (not shown) is arranged to receive foreign objects and non-valid coins output by the reject channel 212 and discharge these objects to a discrimination funnel 310 for presentation to the operator, a front portion of the discrimination funnel 310 being shown in FIG. 3(*a*). The distribution outlet 307 is, as shown in the embodiment of FIGS. 3(*a*)-(*b*), configured to discharge the mixed coins into a rotating funnel 320 for distribution to the coin receptacles (not shown), such as coin bags, attached to receptacle holders (e.g., coin bag holders) 308, which are attached to or formed in an upper portion of receptacle station 304. The configuration of the coin collector 306 is more clearly shown in FIGS. 5(*a*)-(*e*). FIGS. 5(*a*)-(*b*) show various views of the coin processing machine 300 of FIGS. 3(*a*)-(*b*), with some parts omitted for clarity. One example of a suitable connection between the distribution outlet 307 and the rotating funnel 320 is shown in FIG. 5(*b*), wherein an upper portion 321 of the rotating funnel 320 is brought up around and above the lower portion of the distribution outlet 307. Throughout the complete range of rotation of the rotating funnel 320, the relative positions of the fixed lower portion of the distribution outlet 307 and the rotating upper portion 321 of the rotating funnel 320 remain essentially constant or static.

Additional features of the coin collector 306 may be seen in FIGS. 5(*c*)-(*e*). For example, the coin collector 306 is advantageously provided with surface features 312 (e.g., surface contours, protrusions, bumps, dimples and/or ridges) to facilitate the flow of coins from the coin exit channels 261-268 of the sorting head 112 to the distribution outlet 307. One potential configuration of a surface feature 312 comprising a protrusion is shown in FIG. 5(*c*)-(*e*). This surface feature is formed to alter a trajectory of the coins to facilitate coin flow. To maximize space utilization within the coin processing machine, the coin collector 306 may also optionally be provided with openings 313 at a front portion thereof to accommodate a portion of the discrimination funnel 310. This arrangement of the coin collector 306 and discrimination funnel 310 using openings 313 is not necessary for proper functioning of the coin processing machine in accord with the present concepts, but does advantageously serve to minimize the size of the machine.

In an alternative design, an escrow region may be provided between the distribution outlet 307 and the rotating funnel 320. Thus, if an end user cancels a transaction, the coins in the escrow region are returned to the user through another discharge funnel (not shown) rather than being discharged to the upper portion 321 of the rotating funnel 320.

The materials selected for the coin collector 306, discrimination funnel 310, rotating funnel 320, and other plastic surfaces against which the coins might bear preferably comprises a self-lubricated or lubricious surface (e.g., a plastic filled with solid lubricants or oil impregnated) or a low-friction surface. In one aspect, these materials may be formed from Royalite R59-7145 FR ABS. Preferably, the selected material will possess a UL94V-0 Flammability Rating. In other aspects, these components may be formed from an UHMW (Ultra-High Molecular Weight) Polyethylene or alternatively other wear and impact resistant plastics having a low coefficient of friction, which might include DOTMAR Ertalyte, Torlon®, Nylatron®, or even specialty plastics. The lower the overall coefficient of friction between the coins and the coin contact surfaces, the lower the angle of the surface required to convey the coins under the action of gravity. Shallower (i.e., lower angles) conveyance surfaces reduce the stack height of the conveyance surfaces and permit greater design latitude in utilizing the space beneath the coin discrimination unit (e.g., a taller coin bag might be used, more components could be fit into the housing, etc.).

FIGS. 5(*a*)-(*b*) show a side view and a cross-sectional view of the rotating funnel 320. A lower portion 322 of the rotating funnel extends through an opening 361 in a rotating plate 360 to which the rotating funnel 320 is attached. The rotating funnel 320 may be connected to the rotating plate 360 by, as shown in FIGS. 5(*a*)-(*b*), lateral supports 362, but any conventional connection scheme may be employed. Also borne by the rotating plate 360 are a stepper motor 365 geared to permit rotational motion of the rotating plate in a forward and/or backward angular direction. The stepper motor pinion 366 engages a stationary gear 367 disposed beneath and concentrically aligned with a center of the rotating plate 360. A center pin 368, which may comprise a hex shoulder screw, is fixed within the center of the stationary gear 367. Disposed above the center pin 368 is a magnetic rotary encoder, which rotates together with the rotating plate 360. A fixed magnet (not shown) is disposed on or connected to the top of the center pin 368. In the illustrated aspect of the present concepts, the rotation of the rotating funnel 320 is controlled, at least in part, by this magnetic rotatary encoder.

One suitable rotary encoder is the AustriaMicrosystems AS5040, which provides non-contact high resolution encoding (10-bit resolution providing 1024 absolute positions per 360 degrees) over a full turn of 360 degrees. In this design, the encoder chip is mounted on a board disposed above the magnet on the center pin 368 so as to rotate above and in close proximity thereto.

In at least some aspects, the coin processing machine 300 may include rotational guides 369 to enhance the stability of the rotation plate 360. In other aspects, it may be advantageous to mount the components so as to concentrate mass toward a center of the rotating plate 360 and minimize inertia of the rotating plate. In still other aspects, it is desireable to balance the weight on opposing sides of the rotating plate 360 to ensure rotational stability. To this end, threaded openings (not shown) may be provided about a periphery of the rotating plate 360 to permit small weights to be added to selected portions of the plate to tailor the rotational characteristics of the rotating plate.

Other mechanisms may alternatively be employed to achieve rotation of the rotating funnel 320 to properly index the outlet 322 of the rotating funnel to a corresponding opening 371 in support plate 370. Any manner of belted or geared drive system may be used to rotate the rotating plate 360. An example of but one such belted system is represented in U.S. Pat. No. 6,637,576, which is hereby incorporated by reference in its entirety. Similarly, the positioning of the funnel need not be accomplished by a magnetic encoder. Any conventional manner of rotational control may be employed. For example, positioning may be effected by binary code (e.g., forward/backward quadrature) or conventional optical encoder (e.g., integrated quadrature) indexed off of features of the rotating body (e.g., lines or obstructions to light on periphery of rotating body, which may comprise a stepper motor shaft or rotating body attached thereto). Further, although not a preferred embodiment, a stepper motor could be calibrated and indexed Beneath the rotating plate 360 is a support plate 370. Formed within the support plate are a plurality of openings 371 corresponding to a designed number of coin receptacles. In one aspect, flexible grommet seals 372 are provided within each of the openings 371. The grommet seals 372 facilitate flow of coins from the rotating funnel 320 into the receptacle holder 308 associated with the particular opening 371 and further prevent overflow from the coin receptacle. In alternative configurations, resilient brush elements, fabrics, or shields may be used. As noted above, the receptacle holder 308 may be a bag holder.

The coin processing machine disclosed herein is controlled by a controller. The term controller, as used herein, comprises any combination of hardware, software, and/or firmware that may be disposed or resident inside and/or outside of the coin processing machine that may communicate with and/or control the transfer of data between the coin processing machine and a bus, another computer, processor, or device and/or a service and/or a network. The controller may comprise, for example, one or more controllers or processors, such as a central processing unit or units (CPU) or distributed processing unit or unit, communicatively coupled to a local memory comprising a volatile memory (e.g., a RAM), a non-volatile memory (e.g., an EEPROM, SRAM, etc.), and/or a storage (e.g., a hard disk).

The controller may advance the rotating funnel 320 from one coin receptacle (e.g., a coin bag) to another coin receptacle (e.g., another coin bag) upon any of a predetermined number of conditions. In at least some embodiments, the controller may be configured to changeover from one receptacle to another receptacle when the coin receptacle has, for example, reached a certain maximum weight, when the end of a transaction places a weight within a certain range, when the end of a transaction places a weight within a certain limit that may be exceeding in an immediately subsequent transaction based upon a transaction history. These weights may be actual weights, determined by a built-in scale, or approximated weights based on calculations of weight performed by the controller using the count denomination counts and estimated weights for each denomination of coin. The controller may alternatively advance the rotating funnel 320 from one coin receptacle (e.g., a coin bag) to another coin receptacle (e.g., another coin bag) based on estimated volumes, based on calculations of volume performed by the controller using the count denomination counts and estimated volumes for each denomination of coin and estimates on volumetric stacking of the mixed coins with the particular coin receptacle involved. Still further, controller may advance the rotating funnel 320 from one coin receptacle (e.g., a coin bag) to another coin receptacle (e.g., another coin bag) based simply on coin counts, regardless of denomination. Each of these limits, including but not limited to coin weight, coin volume, and coin count, are variable and may be selected to comprise any desired constraints.

A printer (local or remote) is preferably provided for printing out informational labels or sheets specific to the contents of a specific coin receptacle (e.g., coin bag, coin bin) when the coin receptacle is removed or prior to removal thereof. This information may include any information relevant to the conditions of processing, operator, bag contents, bag weight or estimated bag weight based on coin count and denomination, date and/or time of bag removal, date and/or time of processing the first coin and/or the last coin in the bag, coin count, itemized denomination count, audit number, and coin processing machine number. Other items, such as customized headers and logos, may also be printed. This printer may thus print out labels, self-adhesive labels, and/or bag inserts bearing information (e.g., text, numbers, indicia, bar codes, symbols, markings, etc.) about the contents of the coin receptacle and/or processing information. The label may then be affixed directly to the coin receptacle (e.g., coin bag), such as by an adhesive or adhesive layer, and/or may be inserted into the coin receptacle. Some or all of the information may be optionally encrypted so that individuals handling the coin receptacle are not apprised as to the some or all of the information relating, for example, to the contents of the coin receptacle. For example, a bag number, store number, and machine number may be printed in a plain text (i.e., not encrypted), whereas information relating to the contents of the coin receptacle, date and/or time of bag removal, and/or or identification information of authorized person accessing coin receptacle, may be encrypted. When the coin receptacle is delivered to its final destination, the label(s) or insert(s) may then be decrypted.

In aspects wherein an insert is to be placed into the coin receptacle, the print medium of the printer should preferably be selected to withstand intermixing with the coins in the coin receptacle. For example, the print medium could comprise a plastic material or a polyethylene (e.g., Tyvek®) material. The printed medium preferably includes tamper-resistant or tamper-evident features including, but not limited to, anti-counterfeiting measures (e.g., magnetic inks, fluorescent inks, thermally reactive inks, chemically reactive inks, pressure sensitive inks, embedded fibers, micro-printing, dyes, unique paper formulations, etc.) conventionally employed in relation to security paper.

In a preferred aspect, the printer is configured to automatically print the label(s) and/or insert(s) immediately as the coin receptacle is changed. For example, the printer may be keyed to the receptacle holder 308 such that when a latch securing the receptacle (e.g., bag) to the receptacle holder (e.g., bag holder) is moved, a switch or contact is opened (or closed), thereby signaling the controller of the impending receptacle removal. Thus, the label may be immediately affixed to or inserted into the receptacle, thereby minimizing the possibility of error or confusion which might otherwise accompany the removal of multiple receptacles or multiple bags of mixed denominations. In at least some aspects, a duplicate label may be printed and/or electronically stored locally or remotely for auditing and security purposes. The operation of the receptacle holder switch or contact thus signals a receptacle change event when the receptacle station 304 is undocked, which may be determined, for example, by an electronic, magnetic, RF, or optical switch. The printing of the label(s) may also be conditioned upon an output from more than one switch or sensor, such as a simultaneous undocked indication by the receptacle station 304 docking sensor. In this manner, for example, a label or insert will not be printed and logged if a coin bag inadvertently detaches from the bag holder. In such instance, the combination of an open (or closed) switch or contact on the coin receptacle holder 308 and a docked signal for the receptacle station 304 may indicate that the coin receptacle has come loose from or detached from the coin receptacle holder 308 and an appropriate action may be taken by the controller (e.g., stop operation, switch bags, alert user, etc.)

The coin processing machine 300 is configured, as shown, with six coin receptacle holders 308 for six coin receptacles. The coin processing machine 300 may also be configured to employ more receptacle holders 308 and coin receptacles (e.g., 7, 8, 9, 10, 11, 12, 13, 14, 15, or more). It is presently estimated that a population of about twelve coin bags would approximate the capacity of a standard coin bin. In accord with a twelve coin bag configuration of mixed coins, the frequency with which the coin processing machine 300 would have to be taken off line is comparable to that of a coin processing machine using a single, large capacity bin. In other words, the customer would not have to take the machine out of service to change the bags as frequently. In contrast, with conventional systems using single denomination coin bags, the minute that a bag of a given denomination if full, the machine must be taken out of service. In accord with the present concepts utilizing a plurality of receptacles for mixed coins, the controller may continue to advance the rotating funnel (or correspondingly advance a rotating coin receptacle support relative to a stationary funnel) to output mixed coins until all 6 (or more) bags are all full.

Moreover, in accord with the present concepts, a plurality of mixed denomination receptacles (e.g., coin bags, coin cassette, etc.) may be provided in combination with a plurality of single denomination receptacles (e.g., coin bags, coin cassette, etc.). In lieu of the above-noted coin collector 306, a segmented coin collector may be provided to commingle some of the coin denominations output from some of the coin exit channels 261-268, such as is shown in FIG. 2, in the manner disclosed above, while maintaining the separation of the coins output from other ones of the coin exit channels. Thus, the coin processing machine 300 may be configured to mix nickels, dimes, quarters, half-dollars, and dollar coins, but output pennies to one or more (e.g., 1, 2, 3, 4, etc.) separate designated receptacles.

Figure 6:
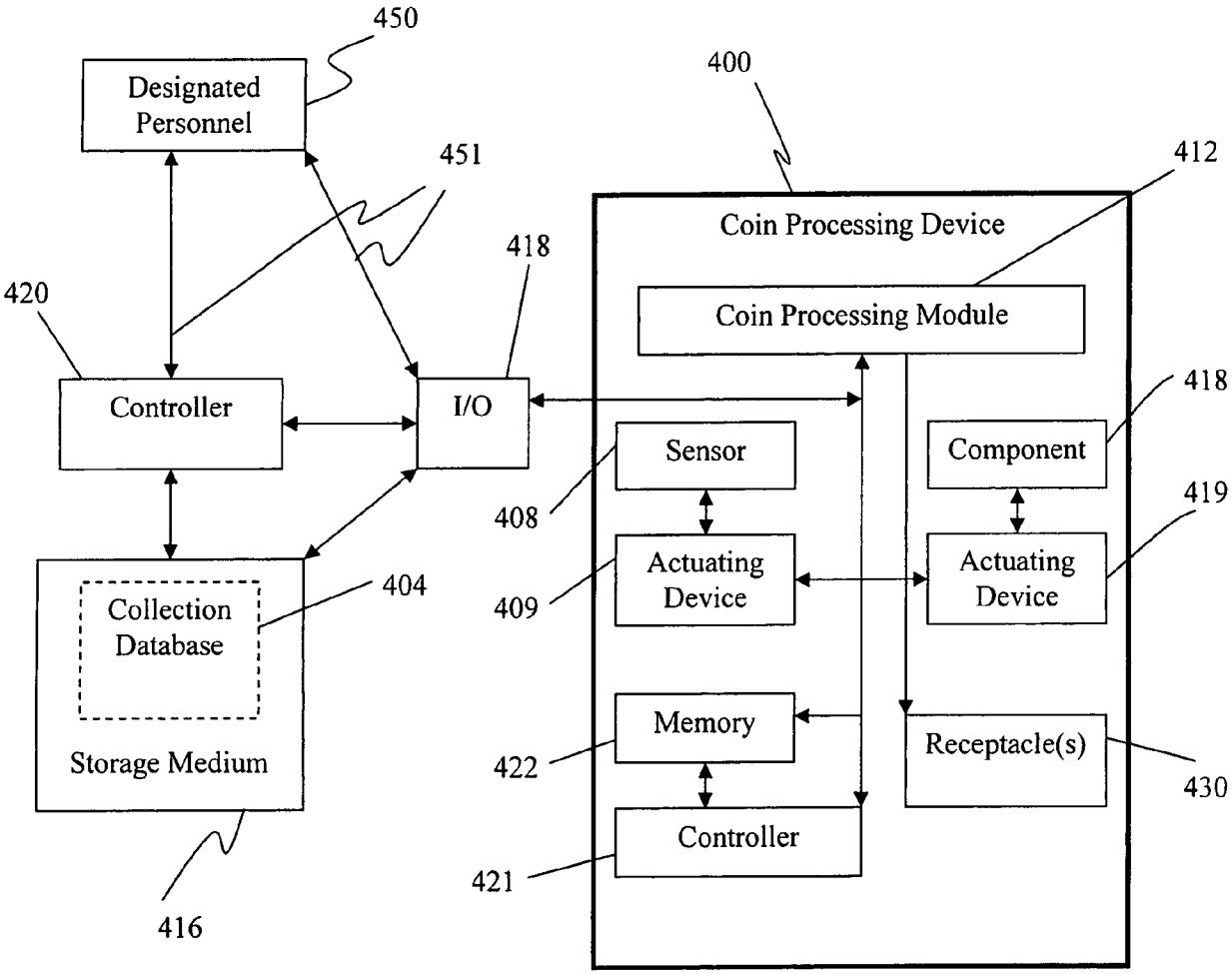
FIG. 6 is a representation of a coin processing system in accord with at least some embodiments of the present concepts.

With reference to FIG. 6, for example, a coin processing machine 400 in accord with at least some aspects of the present concepts may optionally be a fault-tolerant coin processing machine provided a smart error recovery feature. The smart error recovery feature itself is not a feature that is necessarily apparent to a user, but is resident and active behind the scenes. In at least some aspects, one or more sensors 408 are provided within the coin processing machine to monitor various operational parameters of the coin processing machine 400. For example, one or more sensors 408 could monitor one or more characteristics of the motor driving the rotatable disk 114 (e.g., electrical current sensor, electrical voltage sensor, electrical power sensor, temperature sensor, etc.), shown in FIG. 1. As another example, one or more sensors 408 (e.g., optical/light sensor(s), eddy current sensor(s), inductive sensor(s), acoustic sensor(s), etc.) may be arranged to determine whether or not coins or other objects occlude or pass by a particular opening or passage. For example, signals output by the coin sensors (not numbered) provided in each of the exit channels 261-268 of the sorting head 112, as shown in FIG. 2, may be used by the controller to monitor the progress of a coin processing transaction. The sensor(s) 408 may also comprise transducers configured to convert sound into a signal (e.g., microphone), wherein a range of output signals are correlated to a known range of acceptable operating conditions.

Further to sensors 408, FIG. 6 shows that the coin processing machine 400 includes adjustable components 418 and actuating devices 409, 419. Any number of such adjustable components, systems, or devices could be provided. The sensor(s) 408 may comprise without limitation any type of sensor configured to measure any property of the coin processing machine 400 or component, subcomponent, processed article (e.g., coins), system, or subsystem thereof. The actuating devices 409, 419 shown in FIG. 6 may include, for example, but are not limited to, microcontrollers, switches, voltage and/or current regulators, electrical devices, or actuators (e.g., linear actuator, rotary actuator, etc.). The actuating devices 409, 419 include any device or system configured to permit adjustment of a setting for an associated sensor(s) 408 or coin processing machine 400 component 418, either physically or electronically. For example, a micro-actuator 409 may be used to change a position and/or orientation of a sensor 408. The actuating device 419 may be used to directly control a coin processing system data variable (e.g., position of component, etc.). Further, controller(s) 420, 421 may utilize an actuating device 409 to selectively engage and/or disengage an associated sensor 408. Thus, according to some embodiments, if one sensor is malfunctioning, designated personnel may remotely reconfigure the coin processing system to take the malfunctioning sensor off-line and/or readjust other sensors and/or adjust the coin processing system instruction set(s) to temporarily compensate for the loss of the malfunctioning sensor, if necessary, so as to permit the coin processing machine to remain on-line until the time of the actual site-visit by a technician or other designated personnel to repair or replace the malfunctioning sensor. Moreover, in accord with at least some aspects of the present concepts, a designated personnel may independently remotely reconfigure a coin processing system component 418.

The actuating devices 409, 419 may comprise programmable devices which, in at least some embodiments, lend themselves to electronic updates and/or or instruction set changes including, but not limited to, software changes to set-points, addition of new instruction routines, and/or modification of logic within existing instruction routines. These modifications may reside within or be separate from internal controller 421 and/or external controller 420. Although the sensors 408, components 418, and/or actuating devices 409, 419 could be updated or changed locally, changes thereto may be effected remotely in accord with at least some aspects of the present concepts.

Thus, each sensor 408 monitors a particular operational parameter and outputs to a controller 420, 421 a signal associated with the operational parameter. Further, the outputs from a variety of sensors 408 may be logically combined (e.g., AND, OR, NOR, etc.) such that the controller(s) 420, 421 only actuates the actuating device 409, 419 upon a confluence of pre-determined outputs from a plurality of sensors. The controller(s) 420, 421 is programmed to monitor the signal(s) output by the sensor(s) 408 and, responsive to a deviation of a value of one or more sensor signals from an acceptable value for such signal(s), to execute an error recovery instruction set at least once and, in accord with at least some embodiments, a plurality of times (e.g., 2, 3, 4, or more). The actuation of an actuating device(s) 409, 419 is intended influence the operating parameter so as to restore the operational parameter to a condition wherein the signal output by the sensor is within an acceptable value.

In one aspect, three attempts could be made to resolve the problem without informing or requesting intervention by an operator. For example, a coin jam indication is sometimes an erroneous jam or a self-resolving condition that may resolve itself or may be resolved with minimal intervention on behalf of the coin processing machine. In such example, an apparent jamming of a coin or other object may be manifested by factors including, but not limited to, an increased motor current, a marked decrease in the coin counts registered by the coin sensors positioned in or near the coin exit channels 261-268, shown in FIG. 2, a high level of noise measured by a microphone in the coin input region, and/or a constant signal output or absence of a signal from an optical sensor or contact sensor positioned to detect blockage in the coin input region, singly or in any combination. In this example, the actuator may comprise, in at least some aspects, the electric motor 116, shown in FIG. 1.

The corrective action, may comprise, in at least some aspects, a cycling of the electric motor 116 in reverse through a predetermined angular range (e.g., less than one revolution or more than one revolution) at a predetermined speed (e.g., 1 revolution per minute, 5 revolutions per minute, 10 revolutions per minute, less than a quarter-speed, less than half-speed, half-speed, more than half-speed, full speed, etc.), followed by a resumption of forward motion of the electric motor and the rotatable disk 114 at the same or another pre-determined speed. If the signal output by the sensor(s) 408 is not returned to a value that is within an acceptable value, the corrective action may be repeated or a variation of the corrective action may be implemented. For example, in the above example, the characteristics of a subsequent reversal and resumption of operation may be different than in the first instance. Thus, in the above example, the speeds and/or angular ranges may differ from that of the first attempt at correcting the problem.

Alternatively, the actuation of the actuating device(s) 409, 419 may comprise, in the course of attempting to influence the operating parameter so as to restore the operational parameter to a condition wherein the signal output by the sensor is within an acceptable value, the actuation of different actuating devices. For example, responsive to a problem condition manifested by an out-of-bound signal, the controller may first resort to actuation of a first actuating device (e.g., reversing or jogging a motor) and may subsequently resort to actuation of a second (or third, or fourth, etc.) actuating device (e.g., actuation of a diverter, etc.) alone or together with the actuation of the first actuating device.

In at least some aspects of the present concepts, the actuating device may comprise a switch. In one example, the switch may comprise a power on/off switch or a reset switch. In such a configuration, upon indication of an error condition by a sensor, the controller may actuate the switch to automatically "reset" a system of the coin processing machine and/or a subsystem of the coin processing machine. In another example, the controller may reboot itself (e.g., a safe shutdown and safe restart) or run a secondary program, such as a self-diagnostics program.

In some aspects of the present concepts, all data output from the sensor(s) 408 is processed by the controller(s) 420, 421 and saved in a memory 416, 422 for later use (e.g., trending, analysis, comparison, etc.). The memory 416, 422 may comprise subportions or partitions comprising one or more data files, databases 404, memory registers, or the like.

Thus, responsive to a signal output from a sensor 408 indicative of an error or condition warranting attention or continued monitoring, the controller(s) 420, 421 is/are advantageously configured to collect data from the affected sensor(s) 408 or memory 416, 422 to diagnose and/or document and/or correct the condition. The controller(s) 420, 421 may thus analyze, compile and/or store data relating to events leading up to the error, as well as store information relating to how the coin processing machine (or operator, if intervention is required) recovered from the error. This information can be stored locally in a local memory 422 associated with the coin processing machine 400 or sent to a remote memory 416. Wherever the data is stored, the data is available for use by a local controller 421 or a remote external controller 420 for trending, diagnostics, maintenance, or the like. In accord with aspects wherein the controller 420, 421 proactively collects data surrounding the error or anomalous condition, the events leading up to the error can be advantageously used to influence the smart error recovery actions that are taken. For example, some errors may arise from more than one root cause. Although the ultimate outcome may comprise the same error, the events leading up to the error may implicate a particular one of several potential root causes or contributors. Such analysis of the coin processing machine data by the controller 420, 421, utilizing an instruction set to assess the data received corresponding to the various systems and subsystems and/or any other data stored in a local memory 422 or remote memory 416, therefore permits the controller to optimally implement recovery action(s).

As noted above, data output from the sensor(s) 408 is processed by the controller 420, 421 and saved in one or more data files, memory registers, or the like, for later use. In one aspect, the controller 420, 421 may independently analyze data relating to coin processing machine 400, coin processing machine system, coin processing machine subsystem, and/or coin processing machine component 418, such as to trend data and/or analyze data patterns. Responsive to analysis of the data, the controller 420, 421 may independently adjust one or more controllable settings or parameters to compensate for the observed data. In another aspect, the controller 420, 421 may process and output to an external system (e.g., a remote display or remote computer) data relating to coin processing machine 400, coin processing machine system, coin processing machine subsystem, and/or coin processing machine component 418, for use by another controller or by a person having the capability of adjusting one or more controllable settings or parameters of the associated component, subsystem, system, or machine. In one example, the controller 420, 421 may analyze the data of a single sensor 408 and compare such data to known performance characteristics of such sensor or type of sensor to determined whether the sensor has degraded and needs replacement and/or recalibration.

In one example of the above, the data may be used, locally or remotely, to schedule maintenance or preventive maintenance, such as to move up or push back a scheduled maintenance based on observed data, to set or change maintenance minders, to monitor the performance of consumables or wear items to determine when such items need replacement, to monitor cycle times/actuation times, etcetera. The data may also be used to establish a cleaning interval or schedule a cleaning. As one example, a measured laser gain may be beyond operating requirements, indicating that the laser must be cleaned. The controller 420, 421 may then control the application of one or more bursts of air, such as from a shop line or compressed air canister, to the laser and/or receiver to clean the laser and/or receiver. Following such cleaning, the laser may then be recalibrated and the laser gain again checked. In another example, based on the outputs of sensors in or adjacent the coin exit channels 261-268, a 10,000 coin maintenance may be scheduled and/or performed. For example, oil may be applied every 10,000 coins and, upon or near such milestone, the controller 420, 421 may cause the coin processing machine 400 to automatically perform such function.

In accord with the present concepts, a user may optionally be provided with a remote management feature, which may include, but is not limited to, features like machine parameter monitoring (e.g., trending) and service minder monitoring. In essence, any component and/or system of the coin processing machine which is amenable to monitoring (e.g., monitoring a voltage, current, position, pressure, temperature, response, and/or changes thereof over time) may be monitored and the monitored data stored in a storage device such as a floppy disk, a flexible disk, hard disk, magnetic tape, any other magnetic medium, a CD-RW, DVD, optical medium, a RAM, and EPROM, a FLASH-EPROM, any other memory chip or cartridge. The storage device may include any conventional non-volatile media (e.g., optical or magnetic disks), volatile media (e.g. dynamic memory), storage and/or transmission media.

Transmission media include coaxial cables, copper wire and fiber optics and can also take the form of carrier waves, such as acoustic or light waves generated during radio frequency (RF) and infrared (IR) data communications. The transmission media may be thus be utilized not only to output data from the coin processing machine, but may be utilized for local or off-site communication to the coin processing machine. For example, the controller instruction set may be updated through the transmission media communications interface (e.g., I/O port, modem, LAN card, WAN card, 10b-t connector, etc.). As another example, certain coin processing machine variables and set-points may be configured to be changed remotely.

The monitored data may be stored in a data storage medium (not shown) resident in or near the coin processing machine, or may be transmitted off-site to a remote location, such as the manufacturer of the coin processing machine or designated representative. The transmissions may be substantially continuous, intermittent, or on a schedule (e.g., daily packet transmission in a selected early morning hour, weekly transmission at a designated time). The monitored data transmitted by the coin processing machine controller may then be analyzed by designated personnel and/or diagnostic applications. The data may be processed to yield statistical data useful in trending analyses and may be used, for example, to predict failures before they happen or to trend non-obvious degradation in performance so that appropriate corrective actions can be taken prior to such predicted failure. As one example of non-obvious degradation, the monitored data may indicate a high level of discrimination counts in the coin processing machine, even though the transaction was ultimately successful.

In accord with the present concepts, levels of monitoring (e.g., comprehensive monitoring, minimal monitoring, monitoring of selected variables) can be established between the manufacturer and customer. Optionally, each of the various levels may be associated with correspondingly varying fixed, periodic, hourly, or throughput rates to appropriately match the customer's desired application of the coin processing machine and tolerance for machine unavailable with the manufacturers' added engineering resources. The remote management capability thus permits the coin processing machines to be running at peak efficiency. In combination with a customer's requirements the coin processing machines themselves could also be provided in several different levels or grades, each level being fitted with varying degrees of sensors and equipment permitting monitoring of variables of interest. For example, a standard machine might permit monitoring of 25 variables, an upgraded machine might permit monitoring of 50 variables, and a top-of the line machine might permit monitoring of 100 or more variables. In this way, the remote monitoring program desired by a particular customer may be correlated to one of a plurality of different coin processing machine models configured to permit the types of remote monitoring desired by the customer. In this way, the coin processing machines need not all be cost-burdened by features that are not required by all customers.

In accord with the present concepts, the customer may be provided access to a server, either a customer-specific server or a network server accessible by other customers of the manufacturer or service provider, and all coin processing machines maintained by the customer may call into the server, or be polled thereby, via the transmission media communications interface. Once the link has been established between the coin processing machine and the server, or the like, the controller and resident memory of the coin processing machine may be updated (e.g., software updates, set-point updates) and monitored data and coin processing data (e.g., totals, counts, non-counts, etc.) uploaded/downloaded. The remote processing significantly provides the ability to perform unattended software updates. Such activities are advantageously performed during the night when the use of the coin processing machines is typically minimal.

According to some embodiments, the controller communicates with the server using Transmission Control Protocol/Internet Protocol (TCP/IP) language utilizing the Ethernet for LAN clients. WAN clients may be supported through connection into an intranet or a Point-to-Point Protocol (PPP) via a serial interface, such as a dial-up connection. Thus, the controller can transfer a portion of the contents of the local memory to the server for storage in a database associated therewith. In addition, diagnostics or management software located on the server may prompt the controller for specific information or may cause the controller to run a specific routine. For example, the server may prompt the controller to run a balance routine, wherein the transactional data from the coin processing machine 300 is sent to the server in addition to updating the coin processing machine's own local memory. In at least some aspects, the data transmitted by the coin processing machines 300 are transmitted and stored utilizing a proprietary encryption/decryption scheme. The management software may provide, for example, the ability to (i) monitor the coin processing machines 300 current operational status, (ii) query system reports, (iii) allow for asynchronous system fault reporting, (iv) enable and disable the various transaction types supported by the coin processing machines, and (v) perform maintenance from an external device, such as a remote or local computer.

In some embodiments, the management software provides a high degree of system integrity, especially in the areas of security and data storage. For example, in some embodiments, only the Information Technology (IT) department and/or engineering department of the manufacturer may be provided the appropriate privileges to access the database(s) on server or storage of the coin processing machines. In addition, redundancy in the storage of data is provided by maintaining information within the storage of the coin processing machines 300 as well as within the database of the server. Thus, if a coin processing machine 300 becomes non-functional, the data for the transactions completed and components and systems monitored by the coin processing machine can be retrieved from the database.

In some embodiments, the management software is fault tolerant, whereby the interaction of user operations will not cause a functional device to become inoperative. In some embodiments, the management software communicates via an Extensible Markup Language (XML) protocol. All commands and messages received and transmitted by the management software are validated via an XML parser. This type of validation scheme helps prevent both users and third-party systems from causing a functional coin processing machine 300 to become inoperative.

The management software is, in some aspects, programmed so as to allow the management software to be accessed and utilized via a standard web browser. As such, according to some embodiments, the management software is designed to be utilized by a user using Microsoft's Internet Explorer or Netscape's Navigator browsers. The server may include an Active Server Page (ASP) that provides device independent functionality. In some embodiments, the ASP resides on both the server and the coin processing machine 300. Utilizing a browser on the computer, a user, having the appropriate privileges, can direct the browser to either the server's ASP or the coin processing machines' 300 ASP. The ASP processes a user request from the computer, accesses one or more of the coin processing machines' (or the database's 140) immediate or historical data, and formats and presents the content to the user via the user's web browser. The ASP uses input received as the result of the user's request to access data from the local memory or the database and then builds or customizes the page on-the-fly before sending it to the user in a form that can be presented by the user's web browser. In this manner, the ASP is able to provide both the proper data and operational controls to the user in a device transparent mode. Thus, a user is able to gain access to the information located on the database via the use of operations initiated from the management software using, for example, Structure Query Language (SQL).

The management software allows for local monitoring of the coin processing machines 300. Local monitoring is the monitoring of the coin processing machines 300 from within a LAN. According to some embodiments, a user is able to monitor a single coin processing machines 300 or multiple coin processing machines 300 within the LAN via any LAN connection point having a standard web browser. The management software also allows for remote monitoring of the coin processing machines 300 within the scope of a WAN. Similar to LAN monitoring, a user is able to monitor one or more coin processing machines 300 within the network via any WAN connection point having a standard web browser.

In some embodiments, the management software facilitates the creation of real-time and historical management reports from one or more of the coin processing machines 300. In some embodiments, a user may query the database via the management software for real-time management reports that reflect the system totals from the current day or transaction or for a specified time period. Additionally, in some embodiments, a user may query the database for historical management reports that reflect data from prior days, transactions, or time periods.

According to some embodiments, each transaction processed by a coin processing machine 300 is provided a transaction number that identifies the specific transaction. The management software allows a user to track a transaction number back to one of the coin processing machines 300 on the network from which it was processed. In addition, in some embodiments the management software provides bar code support for the coin processing machines 300. As discussed above, in some embodiments the coin processing machine 300 accepts and dispenses various documents that include bar codes or other information-bearing symbol. According to some embodiments, the management software assists with bar code tracking while providing an interface to third-party transaction processors for bar code generation and processing. Thus, when a printed medium bearing a bar code or other information-bearing symbol is to be dispensed from the coin processing machine 300, the management software communicates with, for example, a third-party bar code generating device to determine what bar code should be printed and dispensed.

According to some embodiments, the management software further supports the configuration of one or more of the coin processing machine 300 over the network. The configuration changes may be applied immediately or at a scheduled time depending on the user or system specifications. According to some embodiments, the management software allows the user to revert to a prior configuration, modify a prior or current configuration, or create a new configuration. A backup of the configuration can be stored locally in the local memory of the coin processing machine 300, on the server, on a remote server, or to external media such as a flash card. According to some embodiments, the management software also supports software updates on the server, including database management utilities. At the same time, in some embodiments, the management software supports software updates on one or more of the coin processing machine 300.

In accord with one aspect of the present concepts, the receptacle station 304 may be configured to rotate within the housing to facilitate an operator's access to coin receptacles (e.g., coin bags) suspended from or on receptacles holders. In such embodiment, the rotating funnel 320 noted above could be replaced by a non-rotating funnel. The same control system used for the rotating funnel 320 could also be applied to the rotating receptacle station. A conventional damping mechanism and/or braking mechanism may be provided to control rotation of the receptacle station 404.

The housing 302 of the coin processing machine 300 may optionally be provided with a rear door to permit greater flexibility in accessing the interior of the housing.

While the invention is susceptible to various modifications and alternative forms, specific embodiments thereof have been shown by way of example in the drawings and herein described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

What is claimed is:

1. A coin processing system comprising:

a coin processing machine comprising a coin input region, a coin module configured to receive coins input into the coin input region, to process the coins, and to determine a total amount of the coins, and to output the coins to at least one coin receptacle;

a sensor configured to measure a parameter associated with the coin processing system and output to a controller a signal relating to the measured parameter;

an actuating device operatively associated with the sensor;

a communication interface;

a controller configured to process the signal relating to the measured parameter and to output data relating to the parameter to a memory, the controller being further configured to retrieve the data from the memory and to trend the data relating to the parameter, the controller being further configured to execute an error avoidance instruction set responsive to the trended data exceeding a predetermined setpoint to prevent an error from occurring; and at least one of another controller and another memory located remotely from the coin processing machine, wherein at least one of the signal relating to the measured parameter output by the sensor or the data relating to the parameter output by the controller is output to at least one of the another controller or the another memory through the communication interface, wherein execution of the error avoidance instruction set by the controller causes the actuating device to actuate to influence the parameter associated with the coin processing system to prevent said error from occurring.

2. The coin processing system according to claim 1, wherein the data transmitted to the at least one of the another controller or the another memory is processed to yield statistical data.

3. The coin processing system according to claim 2, wherein the statistical data comprises trending data.

4. The coin processing system according to claim 2, wherein the statistical data comprises trending data for a process variable.

5. The coin processing system according to claim 2, wherein the statistical data comprises trending data for a component.

6. The coin processing system according to claim 1, wherein the controller is configured to regularly output to at least one of said another controller and said another memory data relating to the parameter.

7. The coin processing system according to claim 1, wherein the controller is configured to regularly output said data relating to the parameter at a predetermined time interval.

8. The coin processing system according to claim 1, wherein the controller is configured to regularly output said data relating to the parameter at predetermined coin processing milestones.

9. The coin processing system according to claim 1, wherein the at least one of another controller and another memory located remotely from the coin processing machine are disposed off-site relative to the coin processing machine.

10. The coin processing system according to claim 1, wherein a controller instruction set is configured to be updated through said communication interface.

11. The coin processing system according to claim 1, further comprising a plurality of said coin processing machines, each coin processing machine comprising a coin input region, a coin module configured to receive coins input into the coin input region, to process the coins, and to determine a total amount of the coins, and to output the coins to at least one coin receptacle, a sensor configured to measure a parameter associated with the coin processing system and output to a controller a signal relating to the measured parameter, an actuating device operatively associated with the sensor, a communication interface configured to permit remote communication, and a controller configured to process the signal relating to the measured parameter and to output data relating to the parameter to a memory, the controller being further configured to retrieve the data from the memory and to trend the data relating to the parameter, the controller being further configured to execute an error avoidance instruction set responsive to the trended data exceeding a predetermined setpoint to prevent an error from occurring, wherein execution of the error avoidance instruction set by the controller causes the actuating device to actuate to influence the parameter associated with the coin processing system to prevent said error from occurring, wherein each of the plurality of coin processing machines is configured to communicate with said at least one of another controller and another memory located off-site relative to at least a plurality of said coin processing machines, and wherein at least one of the signal relating to the measured parameter output by the sensor of one of said plurality of coin processing machines or the data relating to the parameter output by the controller of one of said plurality of coin processing machines is output to at least one of the another controller or the another memory through the communication interface.

12. The coin processing system according to claim 11, wherein said at least one of another controller and another memory are configured to execute management instructions utilizing a web browser.

13. The coin processing system according to claim 12, wherein said at least one of another controller and another memory are associated with a server including an active server page.

14. The coin processing system according to claim 12, wherein at least a plurality of the plurality of coin processing machines comprises an active server page.

15. The coin processing system according to claim 13, wherein a user, through the management instructions, is permitted to direct the web browser to the server's active server page.

16. The coin processing system according to claim 14, wherein a user, through the management instructions, is permitted to direct the web browser to a coin processing machine's active server page.

17. The coin processing system according to claim 11, wherein said at least one of another controller and another memory are configured to execute management instructions utilizing a wide area network connection point using a web browser.

* * * * *

UNITED STATES PATENT AND TRADEMARK OFFICE

CERTIFICATE OF CORRECTION

PATENT NO. : 7,946,406 B2
APPLICATION NO. : 11/598370
DATED : May 24, 2011
INVENTOR(S) : Blake et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 466 days.

Signed and Sealed this
Seventeenth Day of September, 2013

Teresa Stanek Rea
*Deputy Director of the United States Patent and Trademark Office*